US011613894B2

(12) United States Patent
Ma

(10) Patent No.: US 11,613,894 B2
(45) Date of Patent: Mar. 28, 2023

(54) AWNING APPARATUS

(71) Applicant: Zhun-An Ma, Ningbo (CN)

(72) Inventor: Zhun-An Ma, Ningbo (CN)

( * ) Notice: Subject to any disclaimer, the term of this patent is extended or adjusted under 35 U.S.C. 154(b) by 478 days.

(21) Appl. No.: 15/972,906

(22) Filed: May 7, 2018

(65) Prior Publication Data

US 2018/0320381 A1 Nov. 8, 2018

Related U.S. Application Data

(60) Provisional application No. 62/503,077, filed on May 8, 2017.

(51) Int. Cl.
*E04F 10/06* (2006.01)
*E04H 15/08* (2006.01)

(52) U.S. Cl.
CPC ..... *E04F 10/0696* (2013.01); *E04F 10/0618* (2013.01); *E04F 10/0625* (2013.01); *E04F 10/0648* (2013.01); *E04H 15/08* (2013.01)

(58) Field of Classification Search
CPC ..... E04F 10/0696; E04F 10/0618; E04F 10/0625; E04F 10/0648; E04F 10/06; E04F 10/0662; E04F 10/0666; E04H 15/08; B60J 11/02
See application file for complete search history.

(56) References Cited

U.S. PATENT DOCUMENTS 272,339 A 2/1883 Shuman
706,820 A 8/1902 Hansen
1,017,515 A 2/1912 Daus
1,095,452 A * 5/1914 Clarke ..... E04F 10/0651 160/70

(Continued)

FOREIGN PATENT DOCUMENTS

AT 144587 2/1936
CH 625300 9/1981

(Continued)

OTHER PUBLICATIONS

European Search Report in European Application No. 18020184.0 dated Sep. 6, 2018 in 8 pages.

(Continued)

*Primary Examiner* — Daniel P Cahn
*Assistant Examiner* — Jeremy C Ramsey
(74) *Attorney, Agent, or Firm* — Knobbe, Martens, Olson & Bear, LLP

(57) ABSTRACT

An awning assembly with a mount portion, an extendable bar assembly, an upper canopy being retractable to a compact configuration adjacent to the mount portion and extendable to an extended position upon extension of the extendable bar assembly to provide shade from above, a lower canopy coupled with the extendable bar assembly and extendable therefrom to provide shade from a side position. The extendable bar assembly comprises a first roller coupled with the upper canopy, a second roller coupled with the lower canopy and a motion generator coupled with the second roller, the motion generator configured to store energy as the second roller is moved to retract the lower canopy and configured to use the stored energy to move the second roller to extend the lower canopy from the extendable bar assembly.

20 Claims, 19 Drawing Sheets

(56) References Cited

U.S. PATENT DOCUMENTS 1,389,002 A 8/1921 Turner
1,815,199 A 7/1931 Goldberg et al.
1,819,400 A 8/1931 Anton
1,823,649 A 9/1931 Goldberg et al.
1,824,188 A 9/1931 Anton
1,948,788 A 2/1934 Goldberg et al.
2,038,045 A 4/1936 Heiser
2,038,259 A 4/1936 Anton
2,144,827 A 1/1939 Anton
2,596,658 A 5/1952 Azzo
2,679,289 A 5/1954 Loos
2,740,470 A 4/1956 D'Azzo
2,823,885 A 2/1958 Azzo
2,880,956 A 4/1959 Beckstett
2,942,291 A 6/1960 Flint
3,188,035 A 6/1965 Owen
3,782,443 A 1/1974 Clauss et al.
3,923,074 A 12/1975 Mckee
3,991,805 A 11/1976 Clauss
4,077,419 A 3/1978 Lux
4,183,687 A 1/1980 Bramwell
4,214,621 A * 7/1980 Wessels ..... E04F 10/0633 160/66
4,469,159 A 9/1984 Lohausen
4,479,526 A 10/1984 Rinaldi et al.
4,557,310 A 12/1985 Castelaw et al.
4,566,516 A 1/1986 Lohausen
4,590,642 A 5/1986 Hesener
4,673,017 A 6/1987 Lauzier
4,683,933 A 8/1987 Dunbar
4,784,204 A 11/1988 Lohausen
4,786,202 A 11/1988 Arnold et al.
4,953,609 A 9/1990 Annin et al.
5,029,363 A 7/1991 Hesener
5,119,867 A 6/1992 Lukos
5,133,397 A 7/1992 Lohausen
5,139,068 A 8/1992 Lohausen
5,232,036 A 8/1993 Brutsaert
5,265,373 A 11/1993 Vollebregt
5,273,095 A 12/1993 Lukos
5,307,856 A 5/1994 Murray
2,214,371 A 9/1994 Heiser
5,365,989 A 11/1994 Bodentien et al.
5,394,921 A 3/1995 Lohausen
5,752,556 A 5/1998 Steadman
5,836,210 A 11/1998 Lohausen
5,924,466 A 7/1999 Kroner et al.
6,024,152 A 2/2000 Rosenich
6,024,153 A 2/2000 Goldman
6,032,909 A 3/2000 Kroner
6,216,762 B1 4/2001 Lin
6,484,069 B2 11/2002 Ab
6,598,612 B1 7/2003 Crowe
6,637,717 B2 10/2003 Li
6,732,018 B2 5/2004 Ab
6,739,371 B2 5/2004 Mukai
6,763,874 B1 7/2004 Chen
6,796,356 B2 9/2004 Kirby
6,796,357 B2 9/2004 Kirby
6,820,673 B2 11/2004 Wessels
6,874,558 B2 4/2005 Mester
6,874,559 B1 4/2005 Hicks
6,904,826 B2 6/2005 Hesener
7,017,976 B1 3/2006 Rutherfors et al.
7,117,565 B2 10/2006 Brutsaert
7,163,042 B2 1/2007 Li
7,179,009 B2 2/2007 Stimpfl et al.
7,353,855 B2 4/2008 Collishaw
D568,662 S 5/2008 Bohlen
7,367,376 B2 5/2008 Forns
7,371,180 B2 5/2008 Cymbal et al.
7,451,797 B2 11/2008 Forns
7,520,091 B2 4/2009 Friedman
7,628,194 B2 12/2009 Wagner et al.
7,645,088 B2 1/2010 Voss
7,740,044 B2 * 6/2010 Gutierrez ..... E04F 10/0696 160/56
7,753,612 B2 7/2010 Bouru et al.
7,789,122 B2 * 9/2010 Ito ..... E04F 10/0611 160/120
D633,976 S 3/2011 Corradi et al.
8,042,596 B2 10/2011 Forns
8,113,260 B2 2/2012 Forns
8,141,613 B2 3/2012 Brutsaert
8,205,656 B2 6/2012 Ma
8,316,910 B2 11/2012 Popa et al.
8,336,947 B2 12/2012 Chenowth
8,347,935 B2 1/2013 Svirsky et al.
8,469,078 B2 6/2013 Drew
8,661,575 B2 3/2014 Chapus
8,726,967 B2 5/2014 Forns
8,800,214 B2 8/2014 Silberman et al.
8,807,513 B2 8/2014 Volin
9,038,648 B1 5/2015 Xie
9,228,358 B2 1/2016 Hornung
9,249,610 B2 2/2016 Reus
9,353,529 B2 5/2016 Richmeier
9,469,996 B2 10/2016 Ma
9,469,997 B2 10/2016 Thompson
9,644,374 B2 5/2017 Ivic
9,644,389 B2 5/2017 Xie
9,831,366 B1 11/2017 Stribling et al.
9,915,062 B2 3/2018 Forsland et al.
9,938,723 B2 4/2018 Shargani
10,006,206 B2 6/2018 Traub
10,066,414 B2 9/2018 Ma
10,094,122 B1 10/2018 Akbulut
10,280,625 B2 5/2019 Byszenski et al.
10,385,574 B2 8/2019 Thompson et al.
10,428,549 B2 10/2019 Ma
10,494,817 B2 12/2019 Bailey et al.
10,560,050 B2 2/2020 Raghunathan
10,604,940 B2 3/2020 Westgarth
10,689,848 B2 6/2020 Castel
10,954,689 B2 3/2021 Ma
2001/0027846 A1 10/2001 Osinga
2002/0014315 A1 2/2002 Toffey
2003/0000154 A1 1/2003 Ignazio
2004/0016511 A1 1/2004 Mester
2006/0108819 A1 5/2006 Wagner et al.
2006/0201635 A1 9/2006 Ridley et al.
2007/0051476 A1 3/2007 Forns
2007/0193700 A1 8/2007 Ornelas et al.
2007/0199662 A1 8/2007 Miller
2007/0246168 A1 * 10/2007 Ito ..... E04F 10/06 160/22
2008/0053624 A1 * 3/2008 Ito ..... E04F 10/0651 160/75
2008/0135145 A1 * 6/2008 Hsieh ..... B60J 11/02 150/166
2008/0277073 A1 * 11/2008 Ito ..... E04F 10/0692 160/67
2009/0025887 A1 * 1/2009 Ito ..... E04F 10/06 160/25
2009/0050277 A1 * 2/2009 Ito ..... E04F 10/0685 160/67
2010/0032106 A1 2/2010 Ma
2012/0134611 A1 5/2012 Voss
2012/0273144 A1 11/2012 Forns
2013/0118696 A1 5/2013 Gavish
2013/0126104 A1 5/2013 Weber
2013/0149023 A1 6/2013 Wiecko
2014/0251552 A1 9/2014 Ma
2016/0102473 A1 4/2016 Ma
2017/0025990 A1 1/2017 Mastrogiannis
2017/0284122 A1 10/2017 Ma
2017/0321427 A1 11/2017 Thompson et al.
2018/0102734 A1 4/2018 Katz
2018/0106046 A1 4/2018 Castel
2018/0363366 A1 12/2018 Ammerlaan et al.
2019/0112832 A1 4/2019 Larin et al.
2019/0128010 A1 5/2019 Ma
2019/0145107 A1 5/2019 Byszenski et al.

(56) References Cited

U.S. PATENT DOCUMENTS

| | | | |
|---|---|---|---|
| 2019/0177980 | A1 | 6/2019 | Ma |
| 2019/0323232 | A1 | 10/2019 | Mitchell |
| 2019/0330837 | A1 | 10/2019 | Nicholas |
| 2019/0368201 | A1 | 12/2019 | Thompson et al. |
| 2020/0087912 | A1 | 3/2020 | Konings |
| 2020/0308841 | A1 | 10/2020 | Bliss et al. |
| 2020/0354962 | A1 | 11/2020 | Whytlaw |
| 2022/0136253 | A1 | 5/2022 | Ma |

FOREIGN PATENT DOCUMENTS

| | | | |
|---|---|---|---|
| CN | 105 083 143 | | 11/2015 |
| CN | 105888366 | | 4/2018 |
| DE | 2613583 | | 3/1976 |
| DE | 2743748 | | 4/1979 |
| DE | 31 10336 | A1 | 2/1982 |
| DE | 84 32 433 | U1 | 2/1985 |
| DE | 3801586 | | 8/1989 |
| DE | 199 49 215 | A1 | 1/2001 |
| DE | 202008006223 | | 9/2008 |
| DE | 20 2013 103994 | | 11/2013 |
| DE | 20 2013 103994 | U1 | 11/2013 |
| EP | 0 001 592 | | 2/1978 |
| EP | 0 001 592 | A1 | 5/1979 |
| EP | 0 119 550 | | 9/1984 |
| EP | 0 810 336 | | 12/1997 |
| EP | 0 810 336 | A2 | 12/1997 |
| EP | 1 076 138 | A1 | 2/2001 |
| EP | 1 092 820 | | 4/2001 |
| EP | 1 092 820 | A2 | 4/2001 |
| EP | 1 342 864 | | 9/2003 |
| EP | 1 609 926 | | 12/2005 |
| EP | 1 767 721 | | 3/2007 |
| EP | 1 895 070 | | 3/2008 |
| EP | 1 995 391 | | 11/2008 |
| EP | 2 071 982 | | 6/2009 |
| EP | 2 280 129 | | 2/2011 |
| EP | 2 565 342 | | 3/2013 |
| EP | 2 565 343 | | 3/2013 |
| EP | 2 607 570 | | 6/2013 |
| EP | 1 964 998 | | 6/2014 |
| EP | 2 845 962 | A1 | 3/2015 |
| EP | 3 144 444 | | 3/2017 |
| EP | 3 312 360 | | 4/2018 |
| ES | 2 342 802 | | 7/2010 |
| FR | 2163097 | | 7/1973 |
| FR | 2564521 | | 11/1985 |
| FR | 2682713 | | 4/1993 |
| FR | 2866854 | | 10/1999 |
| FR | 2899659 | | 10/2007 |
| GB | 2 291 901 | | 2/1996 |
| IT | 20121972 | | 5/2014 |
| JP | S62-146828 | | 9/1987 |
| JP | 2005213997 | A | 8/2005 |
| JP | 5500613 | | 5/2014 |
| JP | 2014-169563 | | 9/2014 |
| JP | 6128894 | B2 | 5/2017 |
| JP | 2020180461 | A | 11/2020 |
| KR | 101320445 | B1 | 10/2013 |
| KR | 20130006147 | U | 10/2013 |
| KR | 102009362 | B1 | 8/2019 |
| WO | WO 1998/001638 | | 1/1998 |
| WO | WO 2010/063386 | | 6/2010 |
| WO | WO2013/121448 | | 8/2013 |
| WO | WO2013/144561 | | 10/2013 |
| WO | WO2014/170510 | | 10/2014 |
| WO | WO2019/038229 | | 2/2018 |
| WO | WO2018/224704 | | 12/2018 |
| WO | WO2019/150055 | | 8/2019 |
| WO | WO2019/186213 | | 10/2019 |
| WO | WO2019/238942 | | 12/2019 |
| WO | WO2020/121356 | | 6/2020 |
| WO | WO2020/121357 | | 6/2020 |
| WO | WO2020/121358 | | 6/2020 |
| WO | WO2020/174195 | | 9/2020 |

OTHER PUBLICATIONS

Partial European Search Report in Application No. EP 09 25 1792, dated Nov. 3, 2011 in 7 pages.

Extended European Search Report in Application No. EP 09 25 1792, dated Feb. 2, 2012 in 11 pages.

Extended European Search Report issued in European Application No. 14158518.2, dated May 16, 2014 in 9 pages.

* cited by examiner

AWNING APPARATUS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57.

BACKGROUND OF THE INVENTION

Field of the Invention

This application is directed to awnings, which block the sun to provide shade in a shadowed area thereof.

Description of the Related Art

Awnings provide shade in a shadow cast by a fabric or similar structure that is supported by a frame. The frame can be connected to a building exterior surface or in some applications to a vehicle or other support surface. Generally the frame extends out from the wall or other support surface unrolling or unfolding the fabric such that the fabric is extended and in some cases stretched. This arrangement provides a large surface area that obstructs the sun which is shining above the awning. Awnings are very useful on a sunny, hot day.

Awnings perform best when the sun is directly overhead or at least high in the sky. On hot days, it is desirable to have shade from the sun at other times of the day. It may be so hot and bright that having shade early in the morning or later in the afternoon or evening is desirable. Positioning the fabric at a non-horizontal angle for the fabric as it extends from the support surface can improve early and late day performance. However, providing a non-horizontal angle arrangement either requires a much higher mount point or results in reduced clearance beneath the fabric or the frame supporting such that one could bump one's head on the fabric or the frame.

Some awnings have been proposed that have two fabrics. A first fabric is generally horizontally placed when the awning is extended and a second fabric hangs downward, i.e., is vertical in orientation. These proposed awnings have a good ability to block the sun when the sun is low in the sky (morning, late afternoon, and evening) but generally had overly complex mechanisms, operations or components.

SUMMARY OF THE INVENTION

An awning is needed that can provide shade from the sun when the sun is high in the sky as well as when the sun is low in the sky. An awning is needed that can block low angle sun rays without compromising clearance of a horizontal awning frame. An awning is needed with multiple fabrics that can operate without multiple crank points and without complex motors that add expense and also are subject to wear, breakage and needing frequent battery replacement.

In one embodiment, an awning assembly is provided that has an awning frame assembly, an upper canopy, and a lower canopy. The awning frame assembly has a mount portion, an extendable bar assembly, and an extendable arm. The extendable arm has a first end coupled with the mount portion and a second end coupled with the extendable bar assembly. The upper canopy has a first end coupled with the mount portion and a second end coupled with the extendable bar assembly. The upper canopy is retractable to a compact configuration adjacent to the mount portion and extendable to an extended position upon extension of the extendable arm to provide shade from above. The lower canopy has a first end coupled with the extendable bar assembly and a second end extendable from the extendable bar assembly. The lower canopy is retractable to a compact configuration within the extendable bar assembly and extendable from the extendable bar assembly to provide shade from a side position. The extendable bar assembly has a first roller coupled with the second end of the upper canopy, a second roller coupled with the lower canopy, and a motion generator. The motion generator is coupled with the second roller. The motion generator stores energy as the second roller is moved to retract the lower canopy. The motion generator is configured to use the stored energy to move the second roller to extend the lower canopy from the extendable bar assembly.

Another aspect of the above embodiment is that the motion generator has a transmission with a first gear coupled to a first axle, the first axle coupled to the first roller, a second gear coupled to a second axle, the second axle coupled to the second roller; and a third gear coupled to a third axle, the third axle journaled in the extendable bar assembly. The third gear has a first portion coupled with the first gear and a second portion coupled with the second gear. The third gear transfers rotation of the first axle into rotation of the second axle and further converts rotation of the second axle into rotation of the first axle.

Another aspect of the above embodiment is that rotation of the first axle in a first direction causes the second end of the upper canopy to be wound around the first roller and simultaneously causes rotation of the second axle in a second direction opposite the first direction. This causes the lower canopy to be un-wound from the second roller.

Another aspect of the above embodiment is that the upper canopy has a shade length and a slack length, the shade length spanning an extension distance comprising the perpendicular distance from a portion of the mount portion facing the extendable bar assembly to a portion of the extendable bar assembly facing the mount portion when the extendable bar assembly is fully extended away from the mount portion. The slack length furls on the first roller with the upper canopy in the extended position.

Another aspect of the above embodiment is that a spring releases stored strain energy to simultaneously extend the lower canopy and to tension the upper canopy.

Another aspect of the above embodiment is that the motion generator comprises a transmission driven by a spring disposed in a housing. The housing is disposed at one end of the extendable bar assembly.

Another embodiment is an awning frame assembly that has a moveable housing and a support arm. The support arm has a first end configured to couple with a ground surface and a second end coupled with the moveable housing. An upper canopy has an end coupled with the extendable housing. The upper canopy is extendable upon movement of the moveable housing away from the ground surface. A lower canopy has an end coupled with the moveable housing. The lower canopy is extendable away from the moveable housing. A transmission is coupled with the upper canopy and with the lower canopy to tension the horizontal canopy and to deploy the lower canopy assembly.

Another aspect of the above embodiment is that the spring driven transmission is configured to simultaneously tension the upper canopy and deploy the lower canopy.

Another aspect of the above embodiment is that a length of the upper canopy is wound about a roller disposed in the moveable housing while the lower canopy is unwound from the roller and extended.

Another aspect of the above embodiment is that the awning assembly is retractable by first unwinding a length of the upper canopy from a first roller disposed in the moveable housing until the lower canopy is fully wound about a second roller disposed in the moveable housing.

Another aspect of the above embodiment is that a third roller configured to be disposed adjacent to the ground surface winds up the upper canopy until the lower canopy is fully wound about the second roller. The awning assembly configured such that further winding of the upper canopy about the third roller moves the moveable housing toward the ground surface.

Another embodiment is a method of extending an awning assembly. The method includes extending a support arm to extend away from a ground surface to move a housing away from the ground surface and to extend an upper canopy away from the ground surface. The method further includes extending a length of the upper canopy from the ground surface after the support arm is fully extended. The method further includes engaging a transmission disposed in the housing to move a first roller disposed in the housing to wind up a slack length of the upper canopy to tension the upper canopy and to move a second roller disposed in the housing to unfurl a length of a lower canopy from within the housing.

Another aspect of the above embodiment is that a ratio of the slack length to the length of the lower canopy being unfurled is defined substantially by a transmission coupling the first and second rollers.

Another aspect of the above embodiment is that the ratio is in the range of 1:1 to 1:10.

Another aspect of the above embodiment is that extending the support arm further comprises unwinding a base roller to extend the upper canopy and further extending the length comprises further unwinding the base surface roller.

Another embodiment is a method of storing an awning assembly, comprising: retracting an upper canopy to unwind a slack length of the upper canopy from a first roller disposed in a moveable housing of the awning assembly; at least partially simultaneously with retracting the slack length of the upper canopy, winding a vertical length of the lower canopy about a second roller disposed in the moveable housing of the awning assembly; and storing potential energy in a resilient member disposed on or in the moveable housing of the awning assembly while winding the lower canopy.

Another aspect of the above embodiment is wherein a ratio of the slack length to the vertical length is substantially defined by a ratio of rotation of the transmission.

Another aspect of the above embodiment is wherein the ratio of rotation is in the range of 1:1 to 1:10.

Another aspect of the above embodiment is wherein the upper canopy is retracted by winding the upper canopy about a base roller.

Another embodiment is an awning assembly with an awning frame assembly with a mount portion, an extendable bar assembly, and an extendable arm. The extendable arm has a first end coupled with the mount portion and a second end coupled with the extendable bar assembly. An upper canopy has a first end coupled with a base roller of the mount portion and a second end coupled with a first roller of the extendable bar assembly. The upper canopy is retractable about the base roller. A lower canopy has a first end coupled with a second roller of the extendable bar assembly and a second end extendable from the extendable bar assembly. The lower canopy is retractable on the second roller and extendable from the extendable bar assembly. The awning frame assembly has a stowed position in which the extendable bar assembly is adjacent the mount portion and an extended position in which the extendable bar assembly is extended on the extendable arm.

Another aspect of the above embodiment is that the first roller is rotationally coupled with the second roller by a transmission on the extendable bar assembly.

Another aspect of the above embodiment is that a rotation of the first roller furls a slack length of the upper canopy onto the first roller and a corresponding rotation of the second roller unfurls a corresponding length of the lower canopy from the second roller.

Another aspect of the above embodiment is that a rotation of the first roller unfurls a slack length of the upper canopy from the first roller and a corresponding rotation of the second roller furls a corresponding length of the lower canopy onto the second roller.

Another aspect of the above embodiment is that the second end of the upper canopy is configured to apply a first tensioning force on the first roller resulting in a first moment on the first roller as the extendable bar assembly is extended between the compact position and the extended position. A second tensioning force is applied by the upper canopy on the first roller resulting in a second moment on the first roller in the extended position. The first moment prevents rotation of the first roller and the second moment allows rotation of the first roller.

Another aspect of the above embodiment is that the transmission has a biasing element that stores energy as the second roller is rotated to retract the lower canopy. The stored energy of the biasing element biases the second roller to extend the lower canopy from the extendable bar assembly.

Another aspect of the above embodiment is that the biasing element is a spring.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments. The following is a brief description of each of the drawings.

DETAILED DESCRIPTION

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Figure 1:
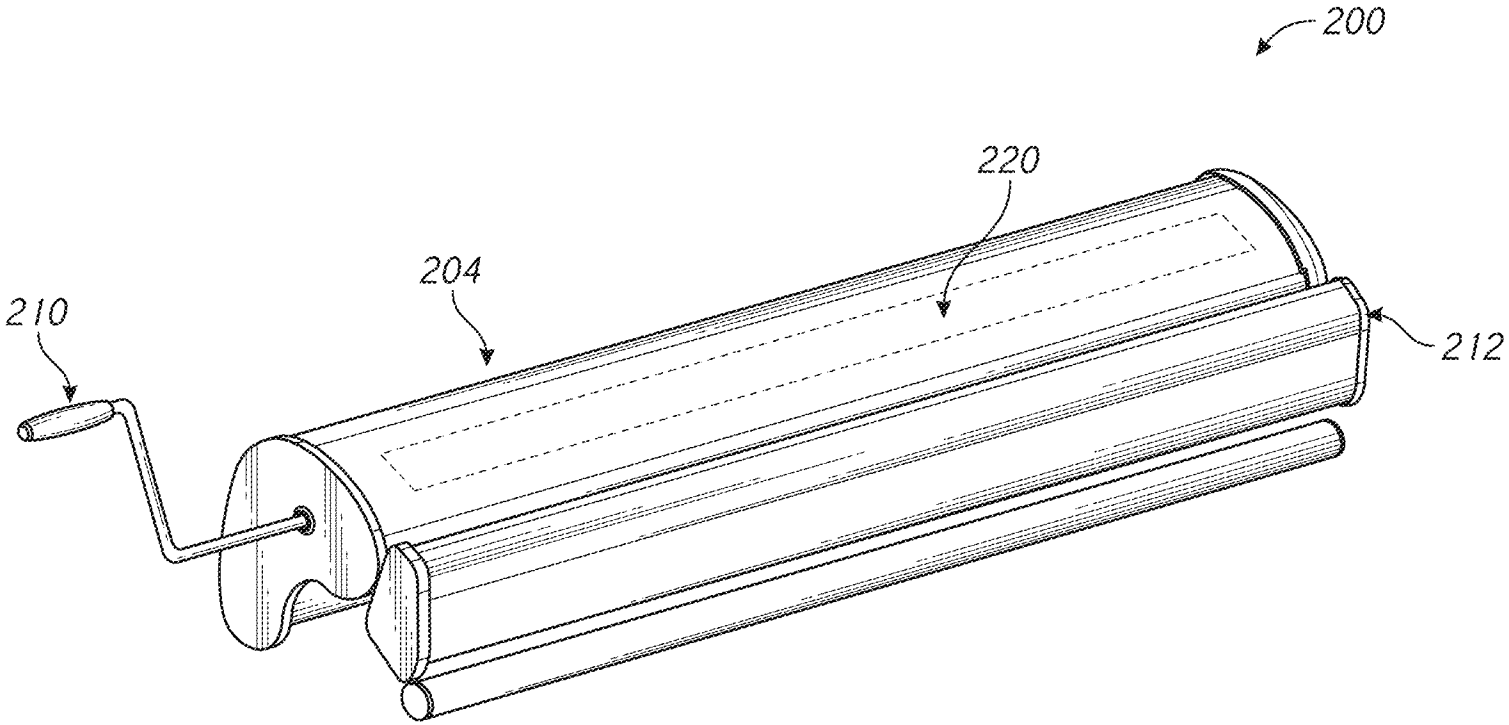
FIG. 1 is a perspective view of an awning assembly in a fully retracted configuration.

FIG. 1 illustrates an embodiment of an awning assembly 200 comprising an awning frame assembly 204. The awning frame assembly 204 can further comprise an extendable bar assembly 212 and a mounting structure 208 to mount on a solid or rigid structure. The extendable bar assembly 212 can be extended away from the mounting structure 208. The extendable bar assembly 212 is one example of a moveable housing in that the extendable bar assembly 212 encloses a potential energy storage device that is adapted to drive extension of a lower canopy and/or to tension an upper canopy. Examples of uses for the awning assembly 200 include the side of a building, over a sidewalk or from the side of a recreational vehicle or other type of vehicle in which a shade structure might be desired. Another version might be for use in over the window of a house. Each of the side of the building, the side of the recreational vehicle and the location over the window of the house are examples of a ground surface as used herein.

In some embodiments, the structure 208 comprises a flat mounting plate with screw holes for mounting on a flat surface of the rigid structure (not shown). In other embodiments, the mounting structure comprises a bracket or rail system such that the awning frame assembly 204 can be removably coupled with the rigid structure. The mounting structure 208 can further include a base roller 220 rotatably coupled with the mounting structure and an awning extender 210 coupled with the base roller 220 for controlling its rotation.

Figure 2:
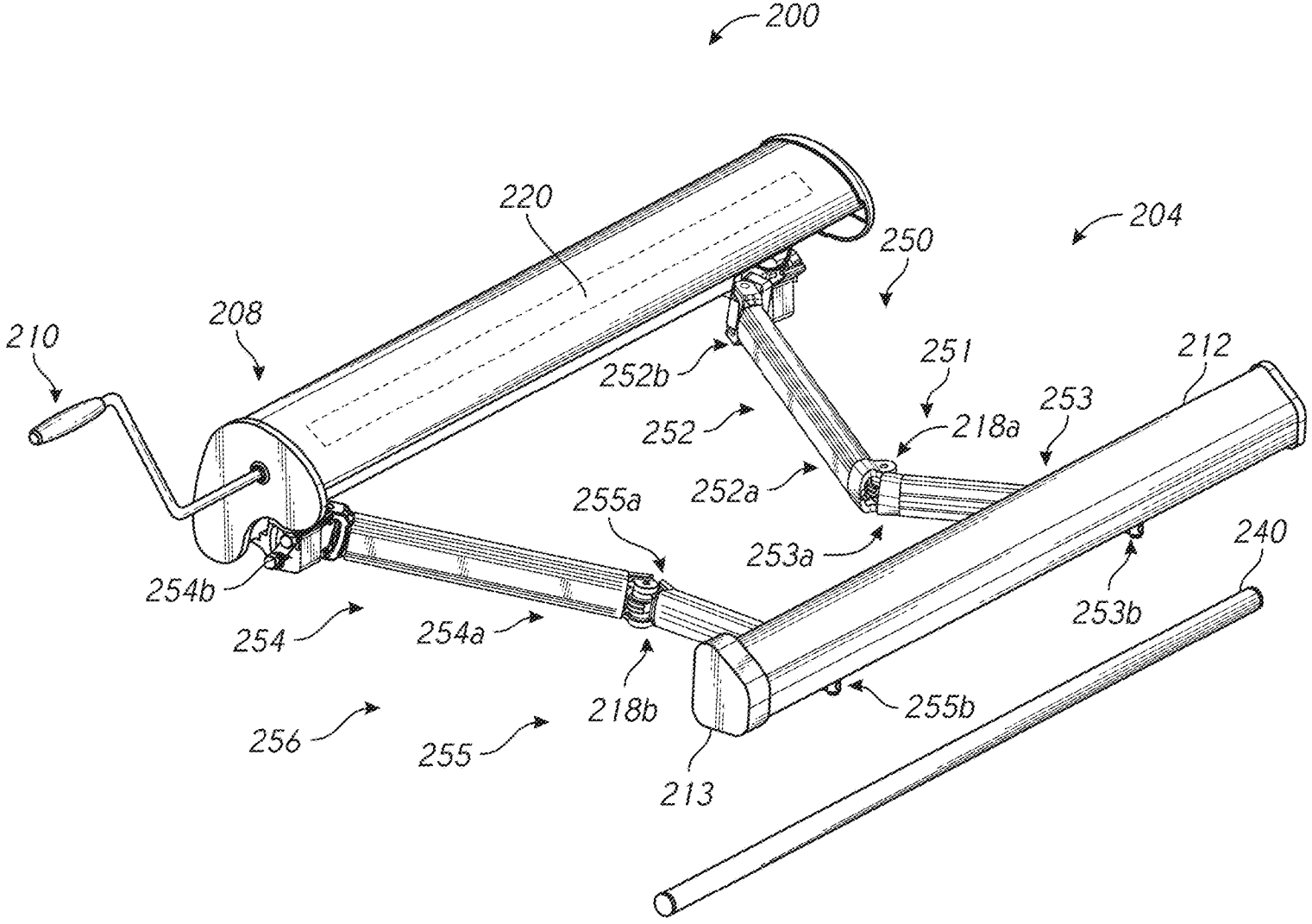
FIG. 2 is a perspective view of an awning frame assembly that can be used in the awning assembly of FIG. 1 with an extendable bar assembly in a partially extended configuration and with fabrics removed for a clearer view of the awning frame assembly.

FIG. 2 shows one implementation of the frame assembly 204 of the awning assembly 200. The extendable bar assembly 212 extended away in a horizontal direction from the mounting structure 208. In some embodiments, the extendable bar assembly 212 extends away from the mounting structure 208 an angle either upwards or downwards. The awning assembly 200 can comprise one or a plurality, e.g., a pair, of extendable arms 250. A first extendable arm 251 of the extended arms can comprise an outer segment 253 and an inner segment 252. The inner segment 252 can be pivotably connected with the outer segment by a joint 218*a* between a first ends 252*a*, 253*a*. A second end 253*b* of the outer segment 253 can be pivotably coupled with the extendable bar assembly 212. A second end 252*b* of the inner segment 252 can be pivotably coupled with the mounting structure 208 Similarly, a second extendable arm 256 of the extendable arms 250 can comprise an outer segment 255 and an inner segment 254. The inner segment 254 can be pivotably connected at a first end 254*a* with a first end 255*a* of the outer segment 255 by a joint 218*b*. A second end 255*b* of the outer segment 255 can be pivotably coupled with the extendable bar assembly 212. A second end 254*b* of the inner segment 254 can be pivotably coupled with the mounting structure 208. By pivoting at these connections, the extendable arms 250 can be folded such that the extendable bar assembly 212 can be positioned adjacent to the mounting structure 208 or extended away from the mounting structure 208 in an extended position by unfolding the extendable arms 250.

The extendable arms 250 can extend between the mounting structure 208 and the extendable bar assembly 212 and provide support for the extendable bar assembly 212 at the extended position. In some embodiments described herein, the extendable arms 250 are biased to extend from a folded position in which the extendable bar assembly 212 is adjacent to the mounting structure 208 to an extended position in which the extendable bar assembly 212 is away from the mounting structure 208 in the extended position. An upper canopy 232 can thus be stretched between the extendable bar assembly 212 and the mounting structure 208.

Any of the pivotable connections of the extendable arms 250 can comprise or be coupled with a biasing mechanism (not shown) that exerts a force or a moment on the extendable arms to unfold them and extend them away from the mounting structure 208. In some embodiments, the extendable arms 250 are spring loaded or otherwise biased to extend out away from the awning mounting structure 208 and to move the extendable bar 212 into the extended position. The biasing mechanism can be as simple as a flexible bar or spring coupled with the pivotable connections. In some embodiments, the biasing mechanism can be coupled with and configured to rotate the inner segments 252, 254 away from the mounting structure 208 about the second ends 252*b*, 254*b*. In some embodiments, the biasing mechanism can be configured to rotate the inner segments 252, 254 away from the outer segments 253, 255.

As discussed above, the mounting structure 208 can further comprise the awning extender 210. If the extendable arms 250 are spring biased to an extended configuration that can correspond to the extended position of the extendable bar assembly 212, the awning extender 210 can be coupled with the base roller 220 to control the unfurling of the upper canopy 232 and thereby control the extension of the extendable bar assembly 212. In some embodiments, the awning extender 210 can be a motor or a crank or similar for controlling the rotation of the base roller 220 and the extension of the upper canopy 232 from the base roller 220.

The upper canopy 232 can be attached at an inner end to the base roller 220 and the length of the upper canopy 232 is wrapped around the base roller 220. An outer end 244 is coupled with the extendable bar assembly 212. By controlling the rotation of the base roller 220 with the awning extender 210 against the extension of the extendable arms 250, the extension of the extendable bar assembly 212 can be controlled, in one embodiment.

If the extendable arms 250 are not spring biased to an extended configuration, the awning extender 210 can be coupled with the extendable arms to control the extension of the extendable bar assembly 212 as described below in the context of FIGS. 11-13 and awning assembly 600.

Figure 3:
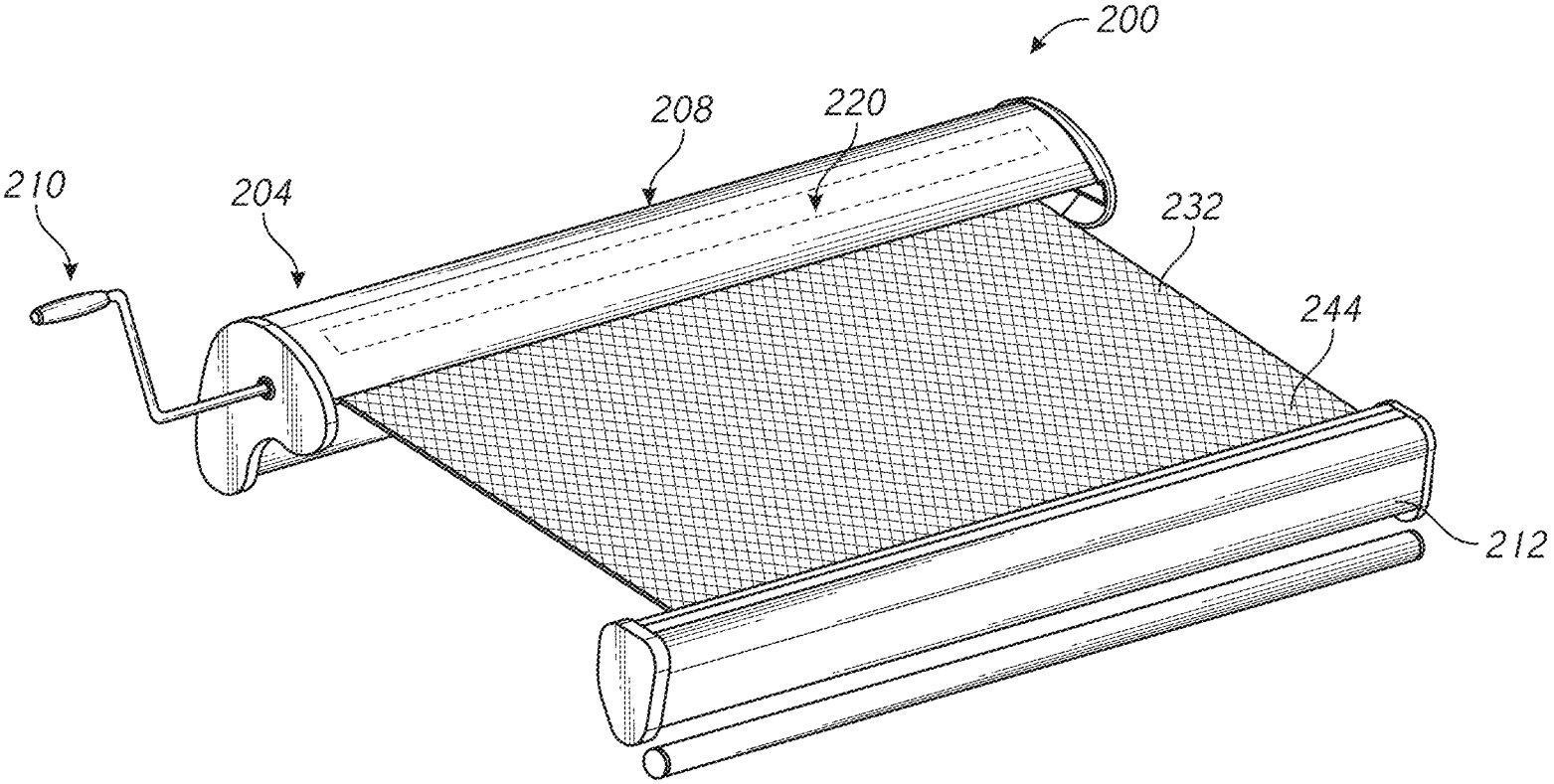
FIG. 3 is a perspective view of the awning assembly of FIG. 1 in which an extendable bar assembly and an upper canopy are extended.

As shown in FIG. 3, the base roller 220 can have the upper canopy 232 furled around a circumferential surface of the base roller 220. In some embodiments, the upper canopy 232 is coupled with the extendable bar assembly 212 at an outer end 244 of the upper canopy 232. As the upper canopy 232 is allowed to be unfurled from the base roller 220 by the awning extender 210 the extendable bar assembly 212 is allowed to be moved laterally outwards by the extendable arms 250. In some embodiments, the extendable arms 250 are biased such that the awning extender 210 acts to control the unfurling of the upper canopy 232 from motion of the arms extending away from the mounting structure 208. The extendable arms 250 can provide a tension across the upper canopy 232 to keep it taut as the extendable bar assembly 212 extends outwardly. The awning extender 210 can be as simple as a hand crank or it could be a motor coupled with the base roller 220 for controlling the rotation of the base roller 220 against biased extension of the extendable arms 250. Other means of controlling the rotation of the base roller 220 can be provided, such as a gear train actuated by a rope, chain, or belt, or a worm gear coupled with the awning extender and configured to turn a worm wheel coupled with the base roller 220. In some embodiments, a user can control the outward extension of the upper canopy 232 by actuating only the awning extender 210.

Figure 4:
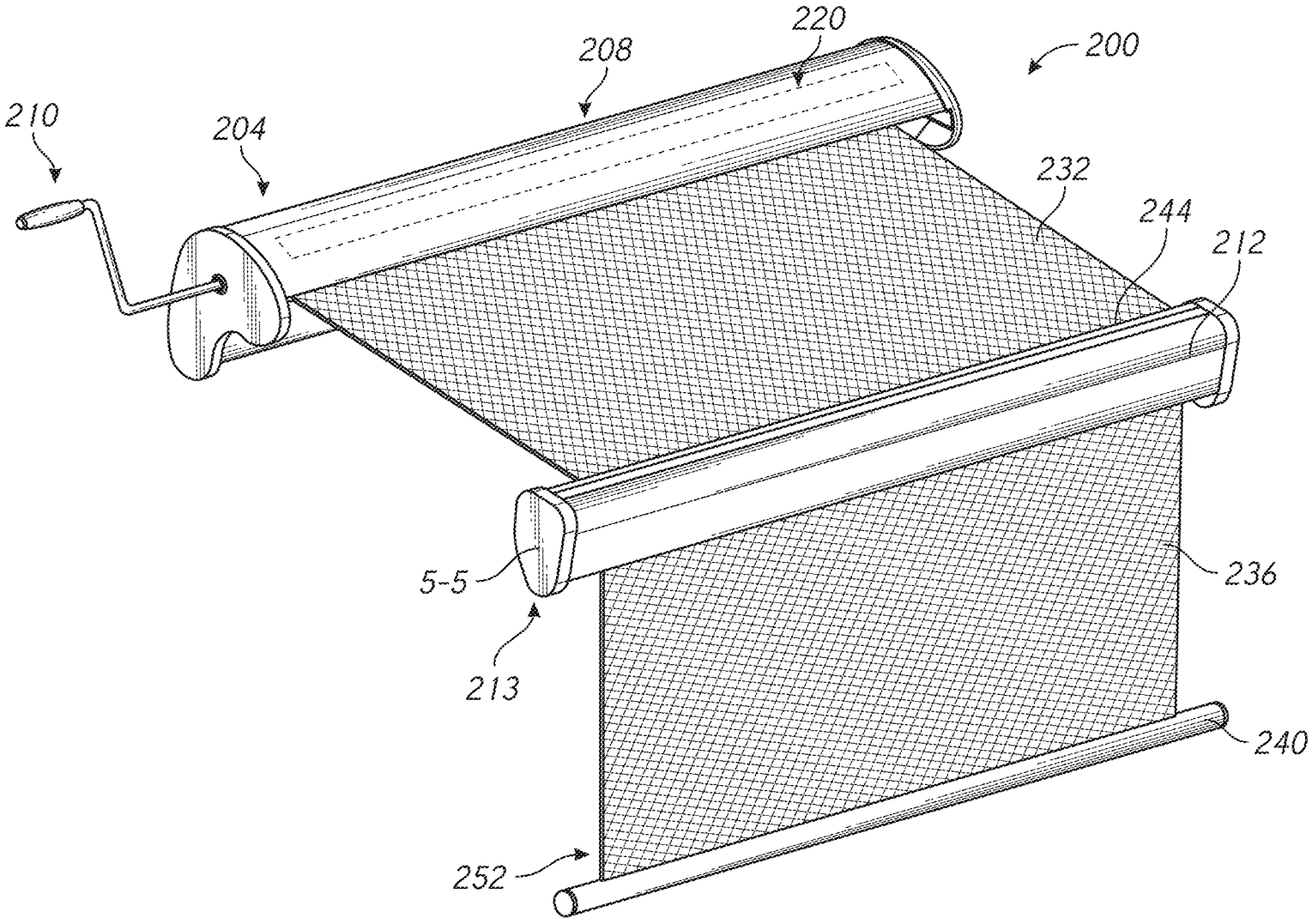
FIG. 4 is a perspective view of the awning assembly of FIG. 1 in which an extendable bar assembly, the upper canopy, and a lower canopy are extended.

In FIG. 4 the extendable bar assembly 212 comprises a lower canopy 236 configured to be extended away from the extendable bar assembly 212. A lower canopy bar 240 can be coupled with a lower end 252 of the lower canopy 236. After the extendable bar assembly 212 is extended by the extendable arms 250 to an extended position (or away from mounting structure 208) the lower canopy 236 can be extended from the extendable bar assembly 212. In some embodiments, this extension of the lower canopy 236 is assisted using potential energy stored in the extendable bar assembly 212. For example, the potential energy can be in the form of potential energy stored by the lower canopy bar 240 by virtue of its weight with respect to gravity. In another embodiment, a spring 290 is provided to store and release potential energy.

FIGS. 5-8 shows that the extendable bar assembly 212 can comprise a slack roller 260 and a vertical roller 264 rotationally coupled with the extendable bar assembly 212. As described in more detail below, the slack roller 260 can be a first roller of an extendable bar assembly 212 that includes a plurality of rollers. The vertical roller 264 can be a second roller of the extendable bar assembly. Optionally, the extendable bar assembly 212 comprises a housing 212*a* containing the slack roller 260 and the vertical roller 264. The housing 212*a* can also have first and second housing compartments 212*b*, 212*c* that comprise hollow cylindrical tubes or spaces corresponding to and containing the slack roller 260 and the vertical roller 264, respectively. The lower canopy 236 can be coupled with the vertical roller 264 of the extendable bar assembly 212 and can be furled and unfurled about a circumferential surface of the vertical roller 264 by rotation of the vertical roller 264. The lower canopy 236 can be extended from the extendable bar assembly 212 by unfurling the lower canopy 236 from the vertical roller 264 and can be retracted by furling the lower canopy about the vertical roller 264. In some embodiments, the upper canopy 232 is coupled with the slack roller 260 at an outer end 244 of the upper canopy 232. A slack length 248 of the upper canopy 232 (as shown in FIGS. 10A-10D) can comprise a portion of the outer end 244 to be furled and unfurled about a circumferential surface of the slack roller 260 by rotation of the slack roller 260.

A motion generator can rotationally couple the slack roller 260 with the vertical roller 264. In some embodiments, the motion generator includes a transmission 272 rotationally connecting the slack roller 260 with the vertical roller 264 using any suitable configuration such as, but not limited to a plurality of gears, pulleys, belts or frictionally engaged wheels, etc. For example, the transmission 272 can comprise gears 273, 275. The gear 273 can be rotationally coupled with the slack roller 260 through an axle 271 that extends through both the slack roller 260 and the gear 273. The gear 273 can thus be rotationally linked with the rotations of the slack roller 260. The gear 273 can be rotationally coupled with a vertical roller 264 by an axle 274. The gear 275 can thus be rotationally linked with the rotations of the vertical roller 264.

The gears 273, 275 include teeth that can be meshed such that rotation from either one is transferred to the other. In some embodiments, the transmission 272 can further comprise a compound gear 276 or another form of an idler gear (not shown) or other indirect coupling between the gears 273, 275. Both of the gears 273, 275 can be meshed with the compound gear 276 or the idler gear or other indirect coupling such that the gears 273, 275 are rotationally coupled or linked directly or indirectly. In some embodiments, a plurality of idler gears is disposed between the gears 273, 275.

Figure 5:
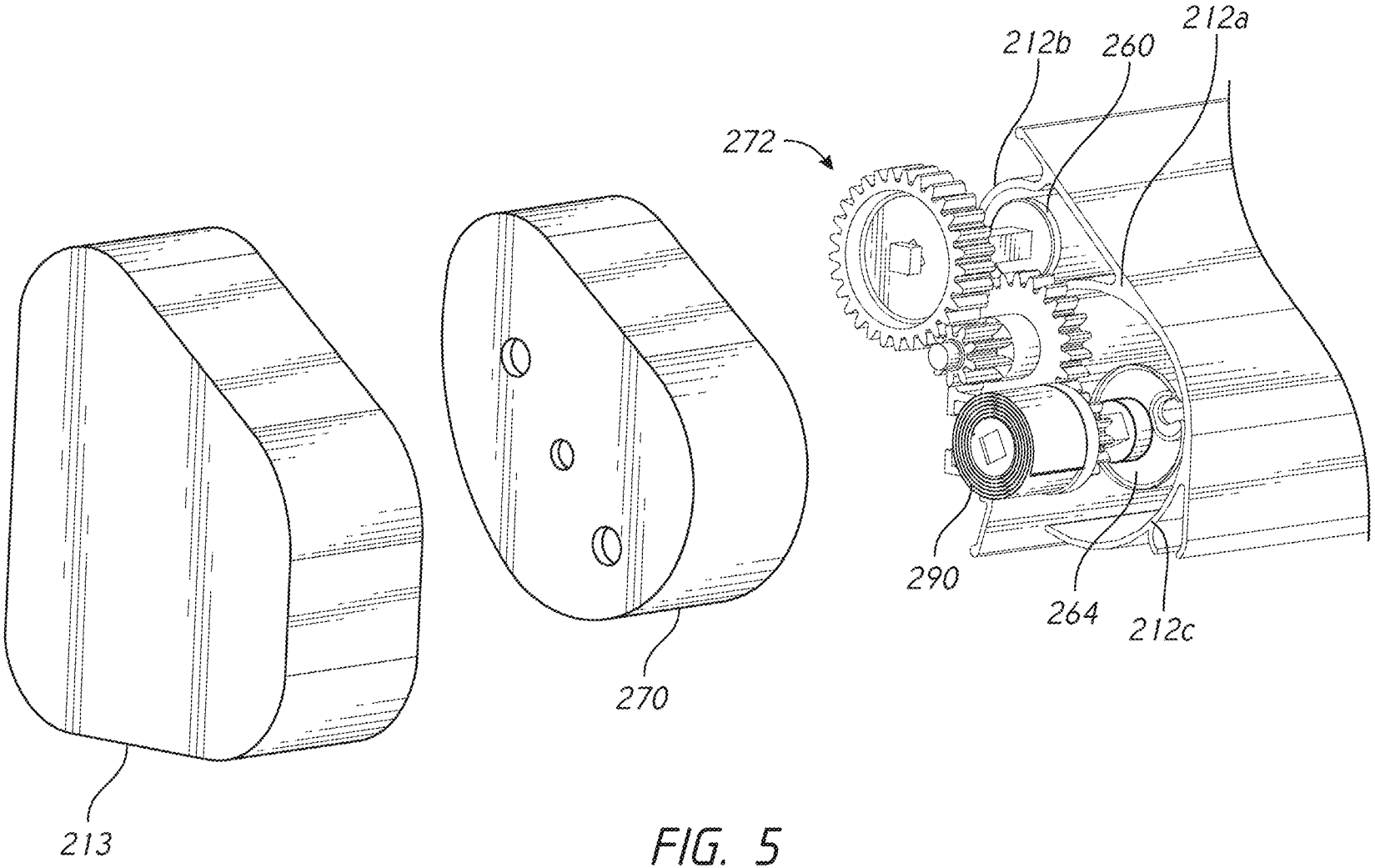
FIG. 5 is an exploded view of a portion of the extendable bar assembly in FIG. 4.
Figure 6:
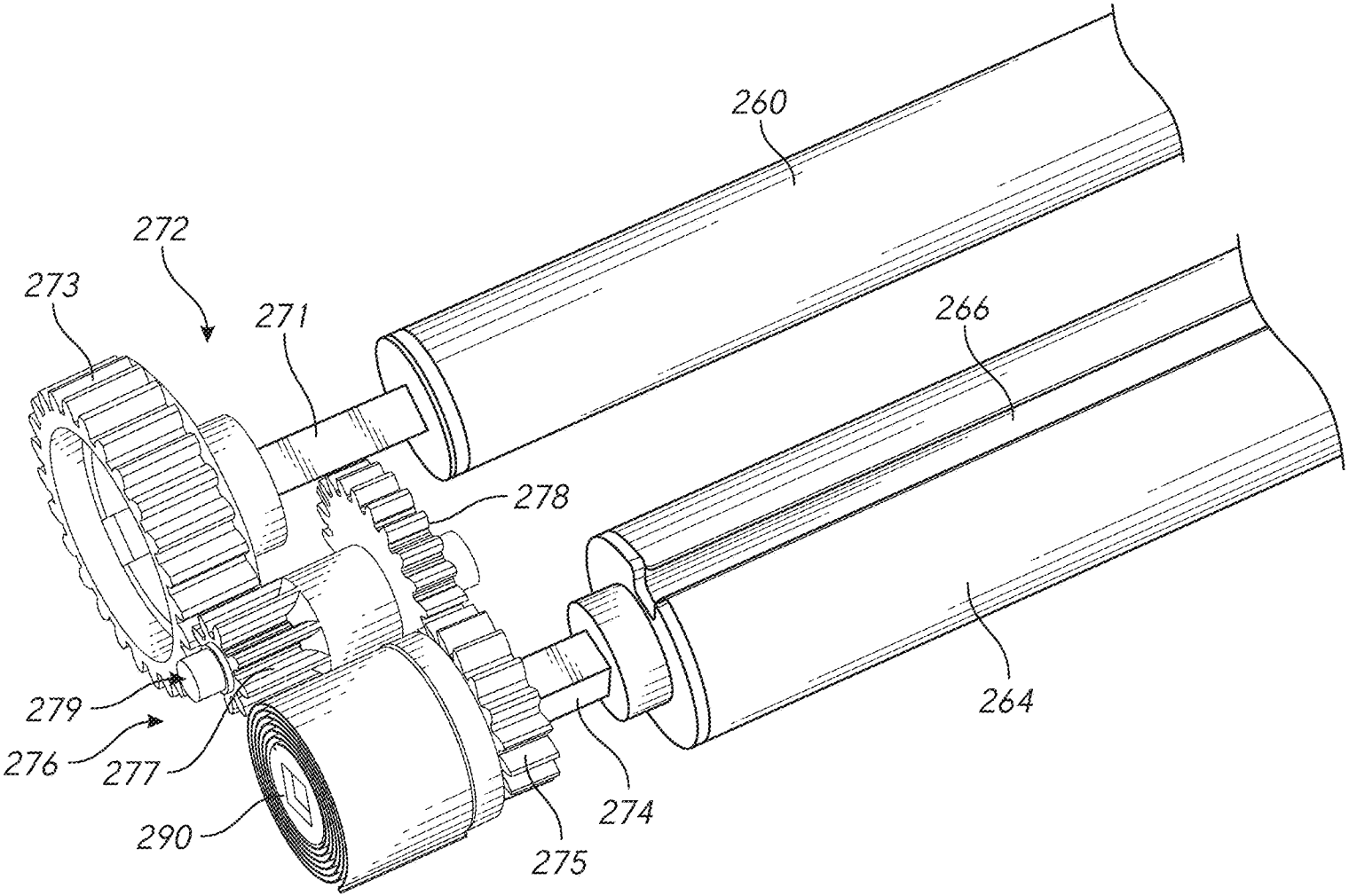
FIG. 6 is an end perspective view of the extendable bar assembly including a slack roller and a vertical roller.
Figure 7:
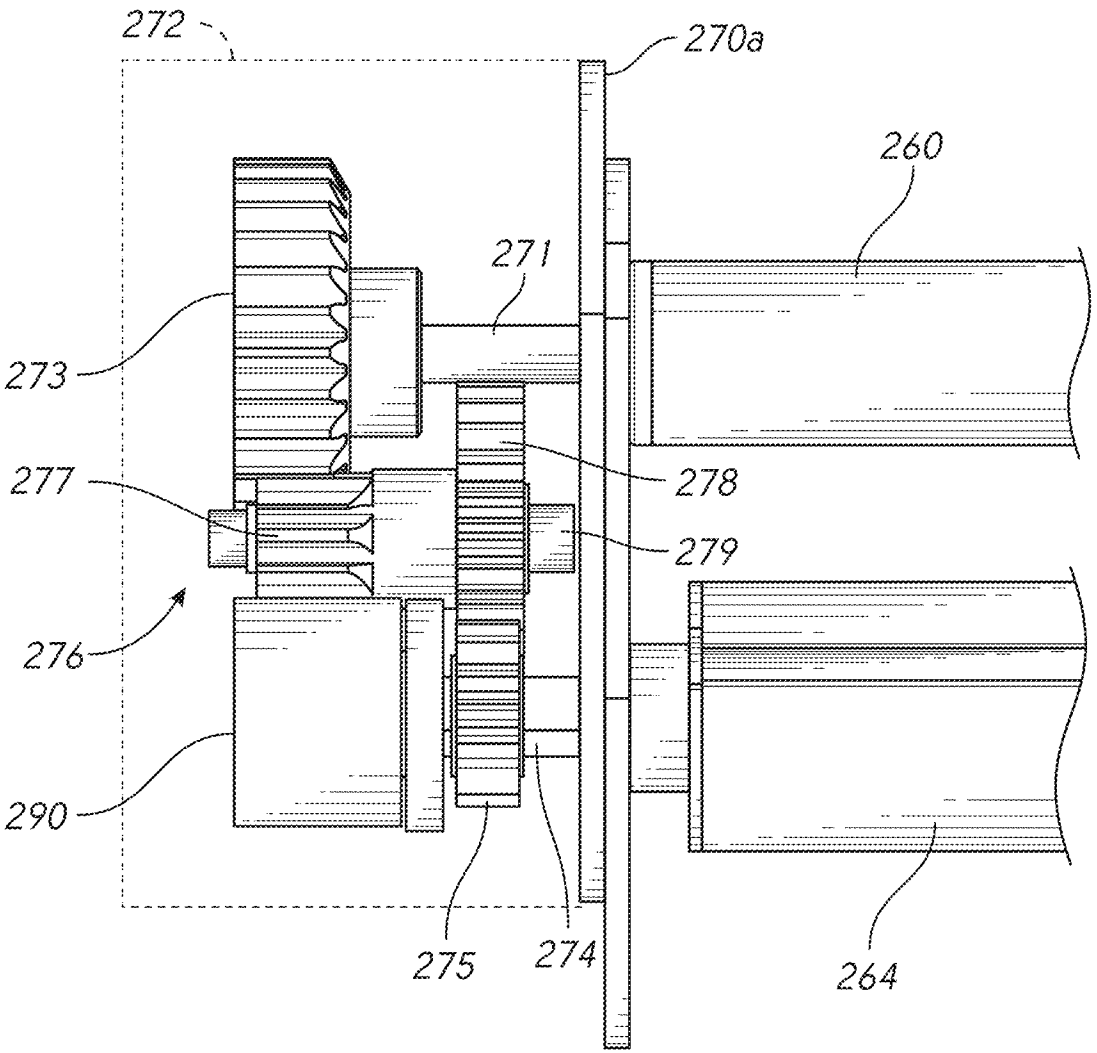
FIG. 7 is a front view similar to FIG. 6 showing a mount plate configured to support the extendable bar assembly.
Figure 8:
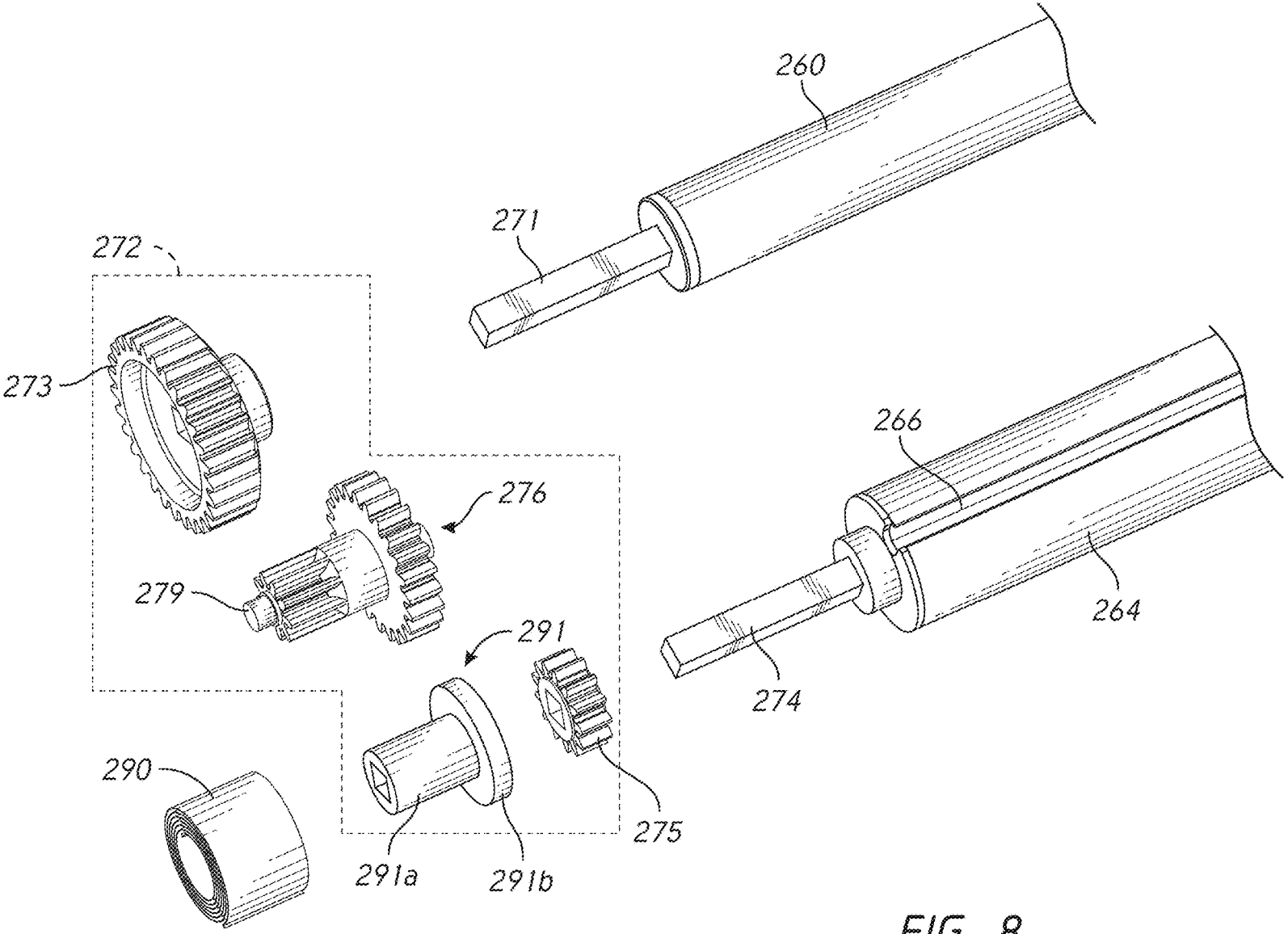
FIG. 8 is an exploded view of some of the components of FIG. 7.

In some embodiments, the transmission 272 can be contained within a housing 270 on an end 213 of the extendable bar 212, such as is illustrated in FIG. 5. The housing 270 can be coupled with a corresponding plate 270*a*, such as is illustrated in FIG. 7. The housing 270 and/or the plate 270*a* can provide structure and spacing for supporting the components of the transmission 272, such as the gears 272, 273 and/or end portions of the axles 271, 274 of the roller 260, 264, respectively. The axles 271, 274 can be coupled with plate 270*a* and/or the housing 270 and rotatably supported thereby. The gears 272, 273 can be supported on the axles 271, 274 and fixedly coupled therewith, such that they rotate with the rollers, 260, 264, respectively.

The transmission 272 can further define a ratio of rotation between the slack roller 260 and the vertical roller 264. In some embodiments, the diameters of the gears 273, 275 can define the ratio of rotation between the rollers 260, 264. In some embodiments, the compound gear 276 has a first end gear 277 having a first diameter and a second end gear 278 having a second diameter. The compound gear 276 can be rotatably supported by or between the plate 270*a* and/or the housing 270 on an axle 279. The first and second diameters of the first and second end gears 277, 278 can be different, such that the compound gear 276 can step up or step down rotations of gears 273, 275 coupled with the first and second gear ends 277, 278. Thus the first and second end gear 277, 278 diameters of the compound gear 276 can in part define the ratio of rotation between the rollers 260, 264.

In some embodiments, the ratio of rotation of input and output shafts of the transmission 272 is relatively high from the perspective of the slack roller 260 with respect to the vertical roller 264. As illustrated, the gear ratio between the gear 273 and the gear 275 is greater than 2:1. Thus, small amounts rotation of the slack roller 260 can translate into large rotations of the vertical roller 264. In some embodiments, the ratio of rotation of the transmission 272 is relatively low from the perspective of the slack roller 260 with respect to the vertical roller 264. Thus, rotation of the slack roller 260 can translate into small rotations of the vertical roller 264. In other embodiments, the ratio of rotation can be approximately equal or 1:1 such that the rotation of the slack roller 260 is approximately equivalent to the rotation of the vertical roller 264. Here, "approximately equal" can take into account the rotation of the rollers, but not the rotation of the already furled length of the canopies about the rollers, which can alter the actual lengths furled or unfurled. In some alternate embodiments a ratio of 1:1, 1:2, 1:5, 1:10, or 1:50 (rotations of slack roller 260 to rotations of vertical roller 264), can be used to use between the slack roller 260 and the vertical roller 264. In other embodiments, the ratio of the rotations of the vertical roller 264 to the slack roller 260 is in a range of 1:1 to 1:50 or in a range of 1:1 to 1:10 or in a range of 1:2 to 1:7 or approximately 1:5. In another embodiment, where the compound gear 276 is provided a ratio between the gear 273 and the portion of the gear 276 meshed with the gear 273 is around 29:9. In one embodiment, where the compound gear 276 is provided a ratio between the other portion of the gear 296 and the gear 295 meshed with the other portion of the gear 296 is 23:13. The ratio of rotation of the input and output shafts of the transmission 272 can be selected based on the desired rotational relationship between the slack roller and vertical roller 260, 264.

In some embodiments, the slack roller 260 rotates and furls a portion of the slack length 248 about the circumferential surface of the slack roller. Depending on the ratio of rotation of the transmission 272 as just described, this rotation of the slack roller 260 has a corresponding rotation in the vertical roller 264 that can furl or unfurl a length of the lower canopy 236. Thus, the slack length 248 and the extension/retraction of the lower canopy 236 can be corresponding according to the ratio of rotation. As one non-limiting example, the extendable bar assembly 212 can include the transmission 272 with the ratio of rotation of 1:5. A 10 cm length of the slack length 248 taken up by the slack roller 260 corresponds to approximately a 50 cm length of the lower canopy 236 being unfurled from the vertical roller 264 and the 10 cm length of the slack length 248 being unfurled from the slack roller correspond to the approximately 100 cm length of the lower canopy 236 being furled on the vertical roller 264. As another example, a 1:5 ratio is provided. In this embodiment a 2.54 cm length of the slack length 248 taken up by the slack roller 260 corresponds to approximately a 12.7 cm length of the lower canopy 236 being unfurled from the vertical roller 264 and the 2.54 cm length of the slack length 248 being unfurled from the slack roller correspond to the approximately 12.7 cm length of the lower canopy 236 being furled on the vertical roller 264. As another example, a 1:10 ratio is provided. In this embodiment a 2.54 cm length of the slack length 248 taken up by the slack roller 260 corresponds to approximately a 25.4 cm length of the lower canopy 236 being unfurled from the vertical roller 264 and the 2.54 cm length of the slack length 248 being unfurled from the slack roller correspond to the approximately 25.4 cm length of the lower canopy 236 being furled on the vertical roller 264. In one embodiment, the slack length is around 380 mm and the length of the extension of the lower canopy 236 is around 1,900 mm.

The motion generator, which can include the transmission 272, can be biased to cause the rotation of the vertical roller 264 in a controlled manner as discussed further below. In some embodiments, such as illustrated in FIGS. 5-8, the transmission 272 includes a spring 290. The spring 290 can be coupled with the axle 274 of the vertical roller 264 and configured to store potential energy. The spring 290 can be configured such that rolling up the lower canopy 236 about the vertical roller 264 to retract or furl the lower canopy 236 will further coil to store potential energy in the spring 290. Other spring configurations can be provided that function by compressions and without coiling and uncoiling. In some embodiments of the spring 290, a first end thereof is coupled directly or indirectly with the axle 274 of the vertical roller 264 and a second end thereof is coupled with a locally fixed surface such as the housing 270 or the plate 270*a* within which the transmission 272 is disposed. Thus, in some embodiments, rotation of the vertical roller 264 and/or the vertical roller gear 275 can directly or indirectly cause or allow of coiling or uncoiling the spring 290. In some embodiment, the spring 290 can be coupled with the axle 271 of the slack roller 260 or the axles 279 of the compound gear 276. The spring 290 could be directly coupled with one of the gears 273, 275, 276 in other embodiments.

In some embodiments, the transmission 272 further comprises a cylindrical member 291 on which the spring 290 is coiled. The cylindrical member 291 can comprise a lower cylindrical portion 291*a* on which the spring is coiled and an upper ridge 291*b*. The lower cylindrical portion 291*a* can include a central aperture within which the axle 274 can be received. In other embodiments, the central aperture of the lower cylindrical portion 291*a* can receive the axle 271 or axle 279. The first (inner) end of the spring 290 can be coupled with the lower cylindrical portion such that the first end rotates with the axles. The upper ridge 291*b* can be raised or protruding from the lower cylindrical portion 291*a* on a least one end of the coupler 290 or on both ends. The upper ridge 291 can provide stability for the spring 290 as it coils. The upper ridge 291*b* can shield or separate the spring 290 from the other elements in the housing 270, such as the gear 275 or other elements of the transmission 272. A second (outer) end of the coiled spring 290 can be coupled with a locally fixed portion of the extendable bar 212, such as the housing 270 or plate 270*a*.

The spring 290 is biased such that when released, the potential energy of the spring can be used to unfurl the lower canopy 236 from the vertical roller 264. In some embodiments this can include sufficient potential energy on its own to completely unfurl the lower canopy 236. In other embodiments the potential energy of the spring 290 coupled with the potential energy due to the elevated weight of the lower bar 240 and that of the lower canopy 236 with which it is coupled to completely and/or partially unfurl the lower canopy 236 from the vertical roller 264. In some embodiments the potential energy can be sufficient to also furl the slack length 248 on the slack roller 260 simultaneously with deploying the lower canopy 236.

In some embodiments, the extendable bar assembly includes a motor (not shown) with an output shaft coupled with a motion generator (which can include the transmission 272) for rotating the vertical roller 264. For examples, a user can initiate the motor and the motor can rotate the shaft and thereby rotate the axles 271, 274 of the rollers 260, 264 to extend or retract the lower canopy 236 and to furl or unfurl the slack length 248 from the slack roller 260. The motor can thus control both the extension of the lower canopy and the tension on the upper canopy 232.

Figure 9:
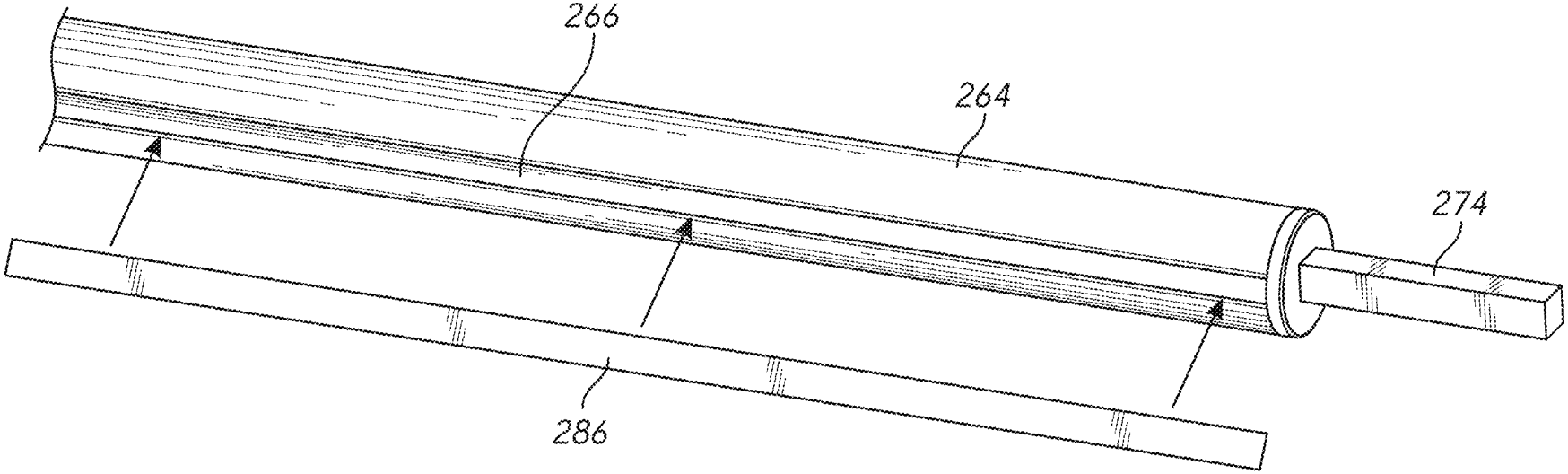
FIG. 9 is a perspective end view of a roller of the extendable bar assembly.

FIG. 9 illustrates an embodiment of the vertical roller 264 with its corresponding axle 274. Although described herein in terms of vertical roller 264 and axle 274, each of the rollers 220, 260 and corresponding axles can have a similar structure. In some embodiments, the axle 274 extends from one side of the vertical roller 264 and out the other side of the vertical roller 264 such that the axle 274 can be journaled within a portion of the extendable bar assembly 212 for rotating the vertical roller 264 about its axis. For example, at least one end can be journaled in the plate 270*a*, as described above. Another end can be journaled in a similar plate at the other end of the extendable bar assembly 212 from the end 213.

The vertical roller 264 can comprise a groove 266 for receiving and securing an end of the lower canopy 236. The groove 266 can simply be a slot or a groove in which a portion of the lower canopy 236 is placed and a separate bar or insert, such as bar 286, can be placed over the material of the lower canopy 236 and held in place by inserting the bar 286 into the groove 266 and securing the bar 286 to the vertical roller 264. The bar 286 can be coupled with the material of the lower canopy 236 prior to being inserted into the groove 266. The bar 286 can be configured as a plurality of short bars each of which is inserted separately into the groove 266. In other embodiments the groove 266 is a receiving slot for sliding a portion of the lower canopy 236 and/or the bar 286 into an interior portion of the vertical roller 264 and for locking one or both of the canopy 236 and bar 286 therein with a clasp, clamp or other locking mechanism, thereby securing the lower canopy 236 to the vertical roller 264. The locking mechanism can include configuring the groove 266 with a width that is less than the diameter of the bar 286 such that the bar can be inserted along the longitudinal axis of the groove but not pulled laterally out of the groove through the opening.

In some embodiments, the axle 274 has a cross sectional shape corresponding to an aperture of the gears 275 such that the gear 275 can be rotationally fixed on the axles 274. For example, as illustrated, axle 274 has a square cross-sectional shape and the cross-sectional shape of the inner aperture of the gear 275 is a corresponding cross-sectional square shape. Other cross-sectional areas can include circle, hexagonal or octagonal but are not limited to these cross-sectional profiles.

Figure 10A:
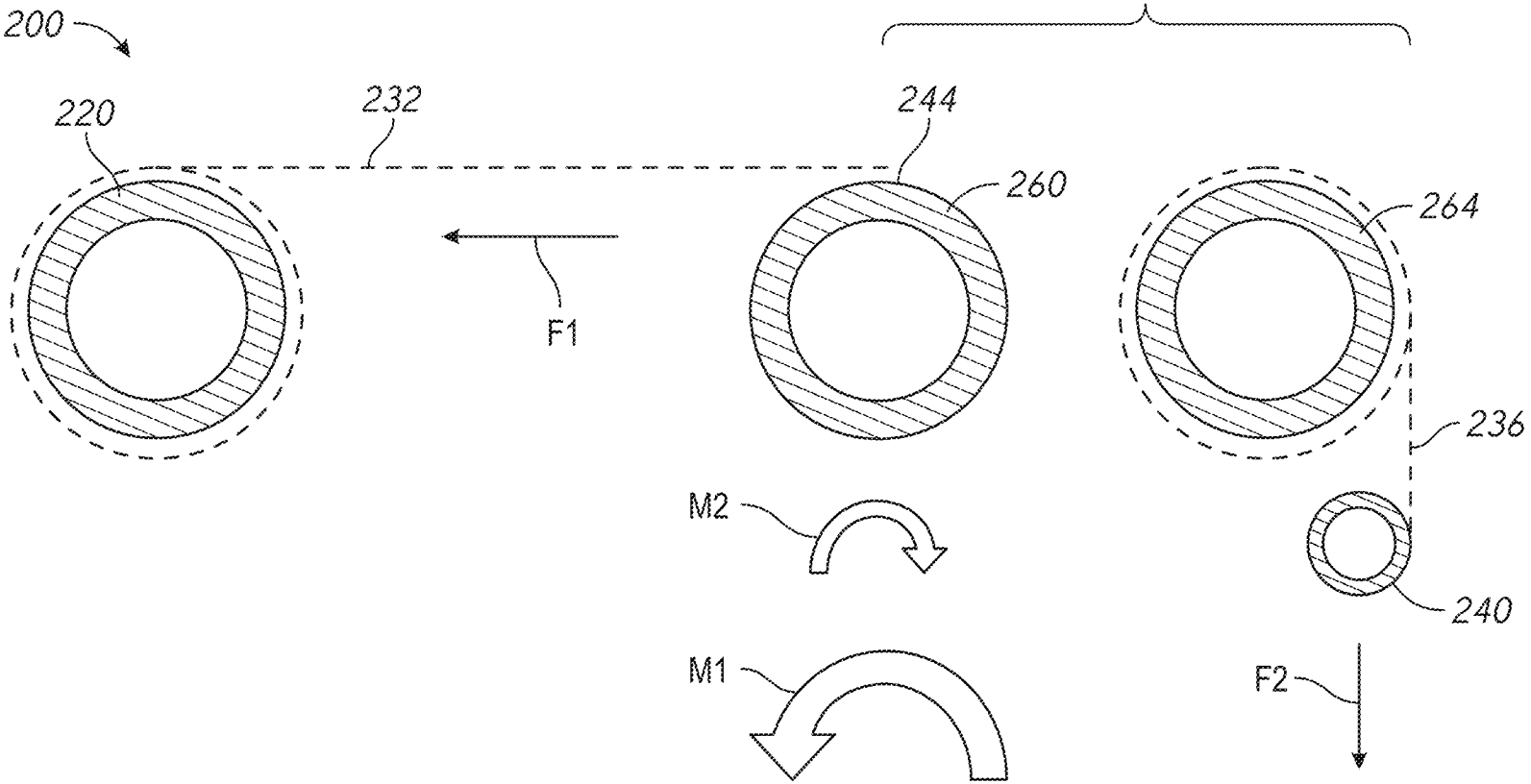
FIG. 10A is a schematic drawing of the awning assembly with the upper canopy partially extended.

FIGS. 10A-10D are schematic figures illustrating various aspects of an embodiment of the present disclosure. FIG. 10A illustrates the awning assembly 200 comprising the base roller 220 with the upper canopy 232 furled around the base roller 220. The assembly 200 also includes the extendable bar assembly 212 and the lower canopy 236. The extendable bar assembly 212 includes the slack roller 260 and the vertical roller 264.

The slack roller 260 can be configured to be rotationally engaged with the extendable bar assembly 212. Rotation of the slack roller 260 can be rotationally controlled by the awning extender 210. The extension of the extendable bar assembly 212 away from the base roller 220, e.g., by the biased extendable arms 250, applies a tension force F1 across the upper canopy 232. The tension force F1 applied to the slack roller 260 at the outer end 244 of the upper canopy 232 can maintain the slack roller 260 in a fixed rotational position with respect to the extendable bar assembly 212 while the assembly 212 is moving away from the base roller 220.

The rotation of the slack roller 260 can be coupled with the rotation of the vertical roller 264, such as through the motion generator or transmission 272. The rotation or non-rotation of the slack roller 260 can determine at least in part the rotation or non-rotation of the vertical roller 264. As the extendable bar 212 is moved out away from the base roller 220 and the tension force F1 of the canopy 232 prevents the slack roller 260 from rotating with respect to the extendable bar 212 or about a central longitudinal axis of the slack roller 260, the vertical roller 264 can also be kept from rotating through the coupling thereof with the slack roller 260. The extension (or non-extension) of the lower canopy 236 from the vertical roller 264 can thus be controlled by the rotation (or non-rotation) of the slack roller 260.

Potential energy of the motion generator of the extendable bar assembly 212 can be stored in and released from the awning assembly 200. Potential energy in the form of a weight F2 of the lower bar 240 attached to the lower end of the fabric of the lower canopy 236 and of the fabric, which are raised above the ground when the canopy 236 is furled about the vertical roller 264. In another example, the potential energy can be stored within the coupling between the slack roller 260 and the vertical roller 264, such as in the spring 290. Alternatively, the rotation of the vertical roller 264 can be motorized, such as by the motor on the extendable bar assembly 212 (not shown).

The tension force F1 on the upper canopy and the slack roller 260 can cause a first moment M1 on the slack roller 260 and thereby prevent the slack roller 260 from rotating as the extendable bar 212 is extended (FIG. 10A) to its extended position (FIG. 10B) away from the base roller 220. In some embodiments, as the extendable bar 212 is extended, the potential energy of the motion generator or the transmission 272 acting on the vertical roller 264 and/or slack roller 260 creates a second moment M2 on the slack roller 260 in an opposite direction from the first moment M1. The second moment M2 can be less than the first moment M1 such that the slack roller 260 is prevented from rotating as it is extended to the extended position illustrated by FIG. 10B.

Figure 10B:
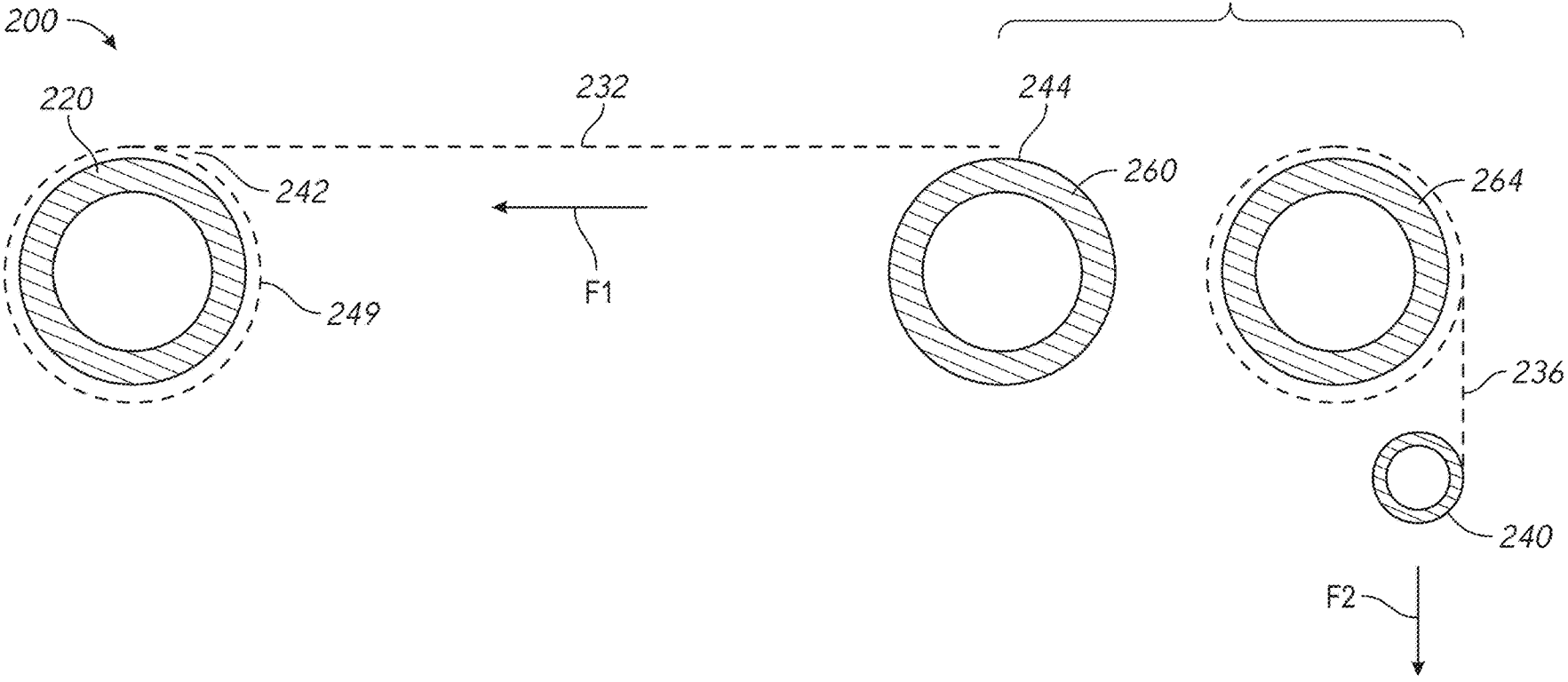
FIG. 10B is a schematic drawing of the awning assembly with the upper canopy fully extended.
Figure 10C:
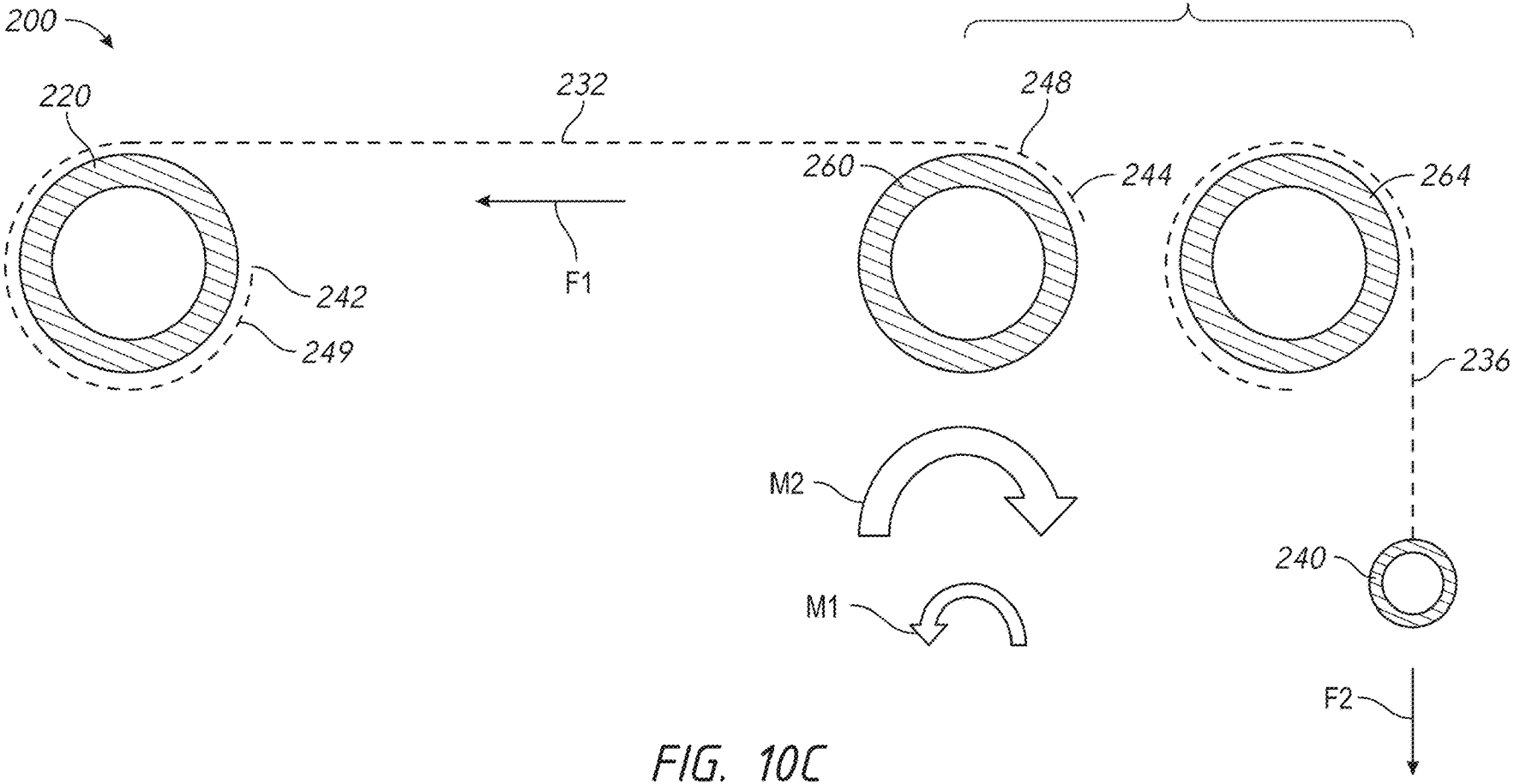
FIG. 10C is a schematic drawing of the awning assembly with the upper canopy fully extended and the lower canopy extended.

FIGS. 10B and 10C show that once the extendable bar assembly 212 reaches its outermost extension the base roller 220 can continue to be rotated to let out an additional terminal length 249 of the upper canopy 232. As the terminal length 249 of the upper canopy 232 is unfurled from the base roller 220, the tension force F1 on the upper canopy 232 can be lessened. This lessening of tension can allow the slack roller 260 to be rotated by the second moment M2, the second moment M2 now being greater than the first moment M1 (illustrated schematically by the relative sizes of the arrows). Rotation of the slack roller 260 can furl the slack length 248 of the upper canopy 232 about the slack roller 260.

In some embodiments, once the slack roller 260 is allowed to rotate or rotates, the vertical roller 264 rotates the transmission 272 between the vertical roller 264 and the slack roller 260. The vertical roller 264 can be rotated corresponding to the rotation of the slack roller 260 and the lower canopy 236 can be unfurled from the vertical roller 264. In those embodiments with biasing of the vertical roller 264, the potential energy stored in or on the extendable bar assembly 212 can be expended to rotate the vertical roller 264 and the slack roller 260. The potential energy can be used to extend the lower canopy 236 from the vertical bar 264.

Once the slack length 248 is taken up by the slack roller 260, further rotation of the slack roller 260 and the vertical roller 264 in the direction of the second moment M2 is prevented by the tension on the upper canopy 232 acting on the slack roller. This can also allow for the upper canopy 232 to again be maintained under tension (e.g., taut) either by the biasing of the extendable arms 250 or by the potential energy of the motion generator or transmission 272.

Figure 10D:
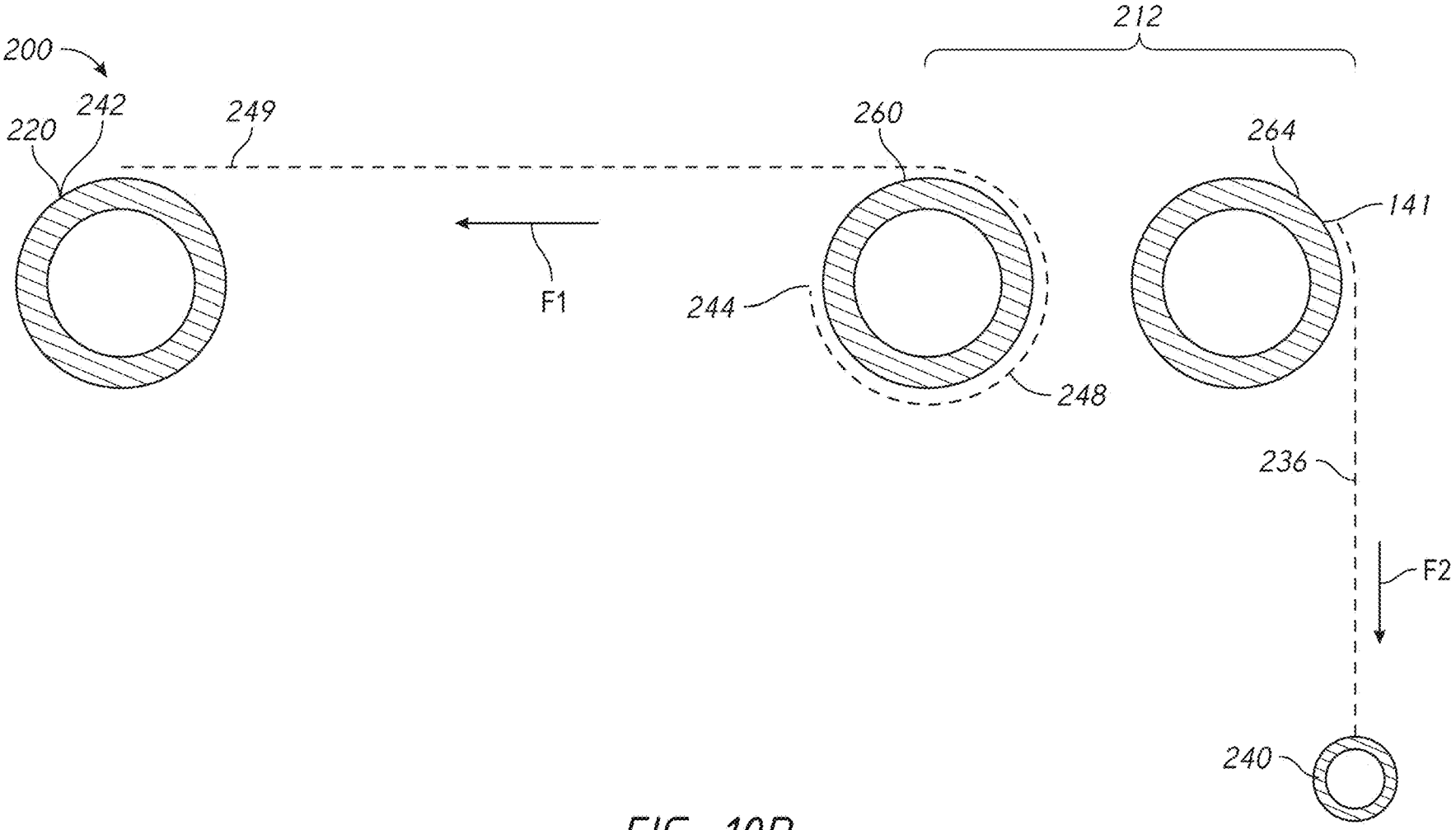
FIG. 10D is a schematic drawing of the awning assembly with the upper canopy fully extended and the lower canopy fully extended.

FIG. 10D illustrates the extension of the lower canopy 236 from the vertical roller 264. In some embodiments, the lower canopy 236 is fully extended from the vertical roller 264 when the extent of the terminal length 249 has been unfurled from the base roller 220. In other embodiments, the lower canopy 236 may be less than fully extended from the vertical roller 264 when the extent of the terminal length 249 has been unfurled from the base roller 220. In some embodiments, the extension of the lower canopy 236 is based on the potential energy of the motion generator or transmission 272.

Retraction of the lower canopy 236 can be accomplished by furling the terminal end 249 about the base roller 220, unfurling the slack length 248 from the slack roller 260 and thereby rotating the slack roller 260 and the vertical roller 264. The rotation of the slack roller 260 is rotationally coupled with the vertical roller 264 as discussed above. Such rotation furls the lower canopy 236 about the vertical roller 264. Retraction of the lower canopy 236 about the vertical roller 264 can store the potential energy in the extendable bar 212, such as through the raising of the lower bar 240 or the coiling of a spring. Retraction of the extendable bar assembly 212 can be effected by continued furling of the upper canopy 232 about the base roller 220. This will retract the arms 250 and stow the extendable bar assembly 212 adjacent to the mounting structure 208.

Figure 11A:
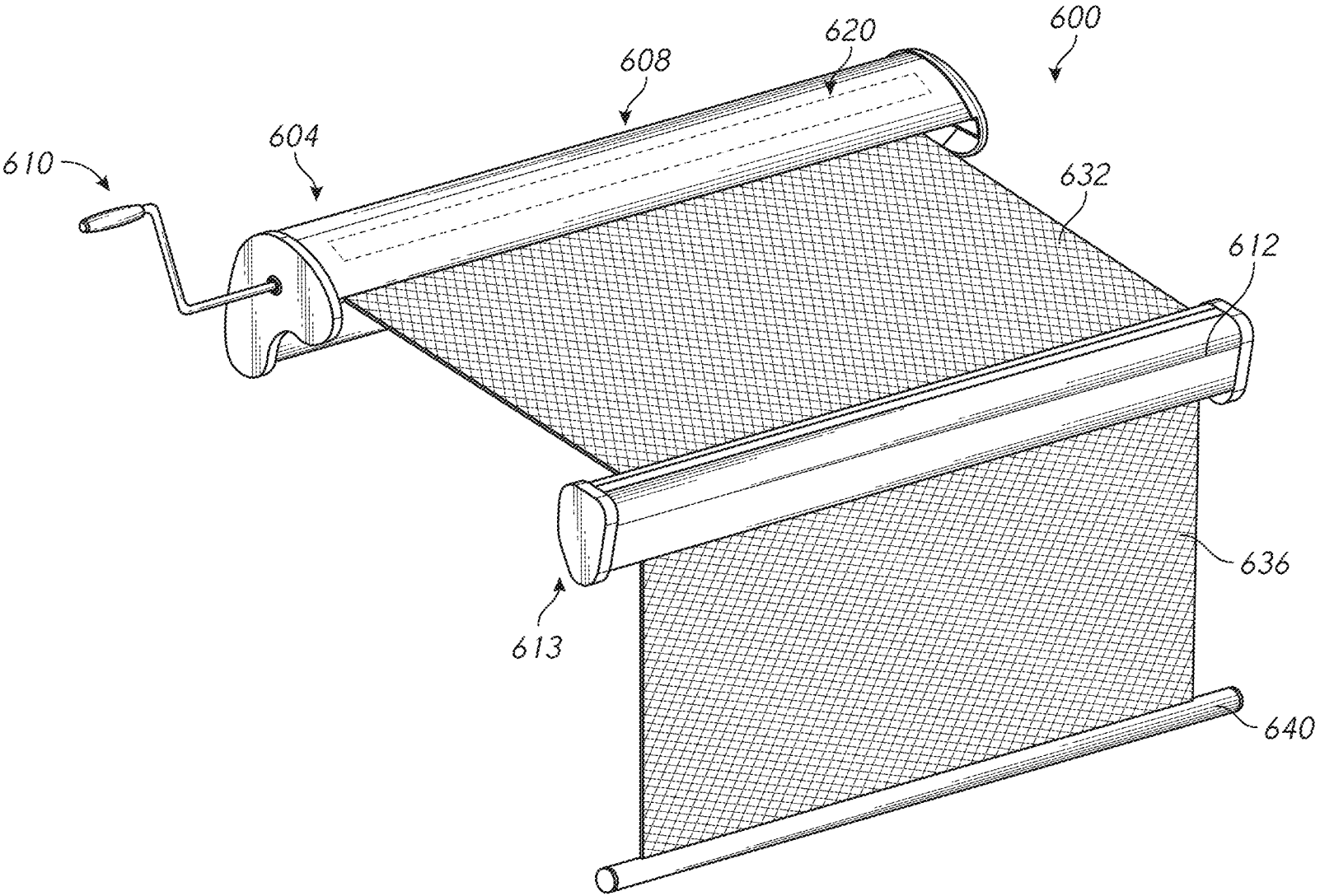
FIG. 11A is a perspective view of the awning assembly of FIG. 11 with an extendable bar assembly in a partially extended configuration.
Figure 12:
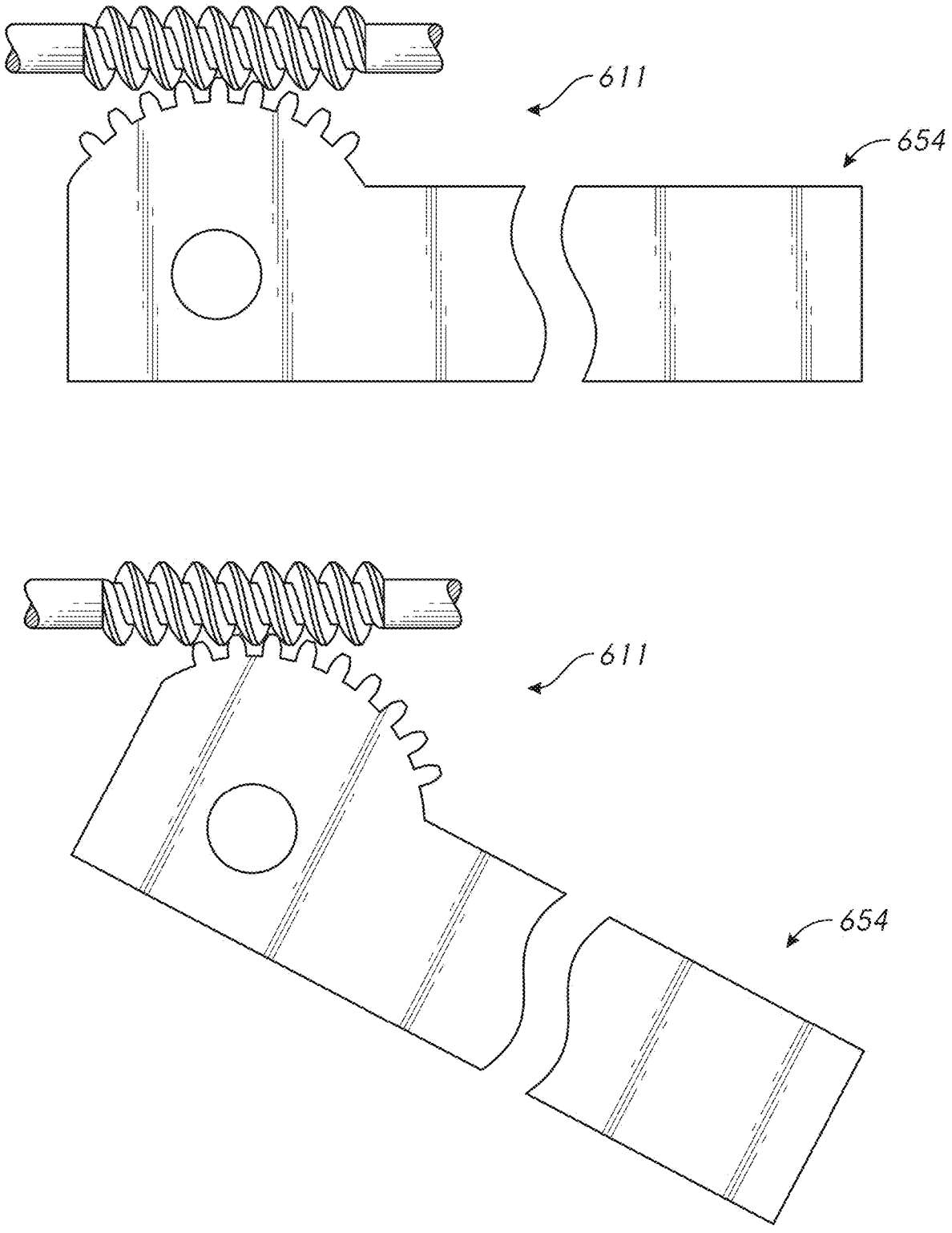
FIG. 12 is a schematic view of an embodiment of a worm gear and worm wheel assembly for extending the extendable bar of the awning assembly of FIG. 11B.

FIG. 11A illustrates an awning assembly 600 according to another embodiment of the present disclosure. Awning assembly 600, similar to the awning assembly 200 described above, can comprise an awning frame assembly 604 with a base roller 620, an awning extender 610, an extendable bar assembly 612, a mounting structure 608 to mount on a solid or rigid structure and from which the extendable bar assembly 612 can be extended. An upper canopy 632 can be coupled on one end with the base roller 620 on the mounting structure 608 and another end coupled with the extendable bar assembly 612. The upper canopy 632 can thus be stretched between the extendable bar assembly 612 and the mounting structure 608. A lower canopy 636 can be extended or lowered from the extendable bar assembly 612.

Figure 11B:
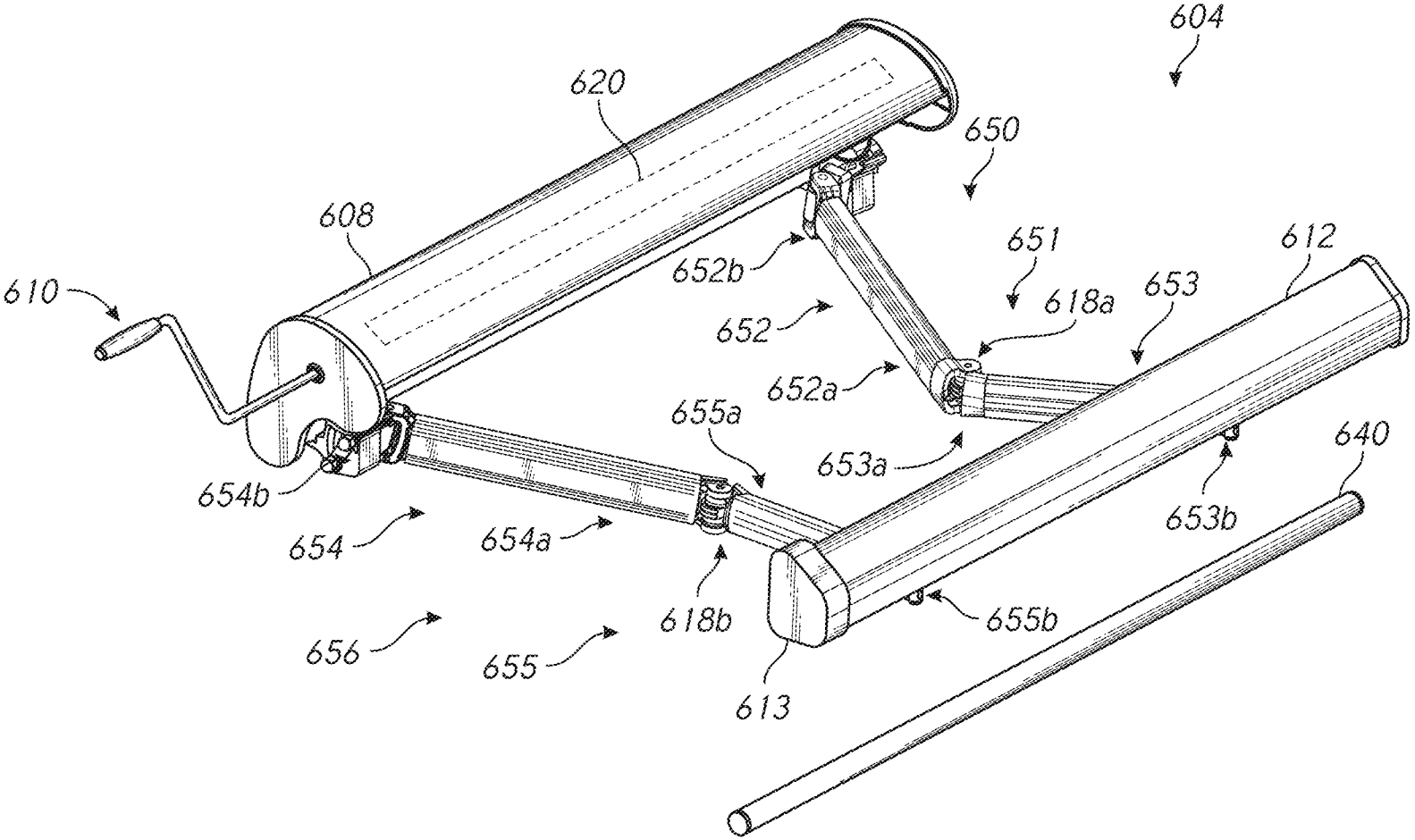
FIG. 11B is a schematic view of one embodiment a mechanism that can be incorporated into the awning assembly of FIG. 11A for extending the extendable bar thereof.

FIG. 11B shows the awning frame assembly 604 with the extendable bar assembly 612 extended away in a horizontal direction from the mounting structure 608. The awning frame assembly 604 can comprise one or a plurality, e.g., a pair, of extendable arms 650. The extendable arms 650 can extend between the mounting structure 608 and the extendable bar assembly 612 and provide support for the extendable bar assembly 612 at an extended position. A first extendable arm 651 of the extended arms can comprise an outer segment 653 and an inner segment 652. The inner segment 652 can be pivotably connected at a first end 652*a* with a first end 653*a* of the outer segment 653 at a joint 618*a*. A second end 653*b* of the outer segment 653 can be pivotably coupled with the extendable bar assembly 612. A second end 652*b* of the inner segment 652 can be pivotably coupled with the mounting structure 608. Similarly, a second extendable arm 656 of the extendable arms 650 can comprise an outer segment 655 and an inner segment 654. The inner segment 654 can be pivotably connected at a first end 654*a* with a first end 655*a* of the outer segment 655 at a joint 618*b*. A second end 655*b* of the outer segment 655 can be pivotably coupled with the extendable bar assembly 612. A second end 654*b* of the inner segment 654 can be pivotably coupled with the mounting structure 608. By pivoting at these connections, the extendable arms 650 can be folded such that the extendable bar assembly 612 can be positioned adjacent to the mounting structure 608 or extended away from the mounting structure 608 in the extended position by unfolding the extendable arms 650.

The awning extender 610 can be an electric motor or a hand crank having a shaft coupled with one or more of the extendable arms 650 and configured to control the extension of the extendable arms 650 between the stowed and extended positions. For example, FIG. 12 illustrates a worm wheel and worm gear set 611 coupled with the inner segment 654 of the extendible arm 652. The worm gear can be coupled with the awning extender 610 and configured to rotate in response to actuation of the awning extender 610. For example, the shaft of the awning extender 610 can be coupled with the worm gear either directly or through a gear train. The worm gear can be coupled with the worm wheel which rotates in response to rotation from the worm wheel. The rotation of the worm wheel controls the rotation of the inner segment 654 about its pivot and thus the extension and retraction of the extendable arms 650 and the extendable bar assembly 612.

The base roller 620 can have the upper canopy 632 furled around a circumferential surface of the base roller 620. The extension of the extendable bar assembly 612 and the extendable arms 650 unfurls the upper canopy 632 from the base roller 620. As the awning extender 610 moves the extendable arms 650 laterally outwards, the upper canopy 632 unfurls from the base roller 620. In some embodiments, the base roller 620 includes a brake 624 (described more fully in the context of FIGS. 13A-13C) such that the base roller 620 can create a tensioning on the upper canopy 632 and counteracts the motion of the arms extending away from the mounting structure 608. In some embodiments, the brake 624 comprises a rubber foot applied against the base roller 620, such as on an inside surface of the base roller 620. The base roller 620 can thus provide a tension across the upper canopy 632 to keep it taut as the extendable bar assembly extends outwardly.

The extendable bar assembly 612 can have a structure and functionality similar to the extendable bar assembly 212 as described above and illustrated in FIGS. 5-8. For example, the extendable bar assembly 612 can comprise a slack roller 660 and a vertical roller 664 rotationally coupled with the extendable bar assembly 612. The lower canopy 636 can be coupled with the vertical roller 664 and can be furled and unfurled about a circumferential surface of the vertical roller 664 by rotation of the vertical roller 664. A motion generator, such as a transmission 672, can rotationally couple the slack roller 660 with the vertical roller 664. The transmission 672 can have the same structure and functionality as the transmission 272 described above. The transmission 672 can comprise gears 673, 675, a compound gear 676, a housing 670, a mounting plate 670*a*, and the axles 671, 674, and 679 of the corresponding gears 673, 675, and 676, respectively. The axles 671, 674, and 679 can be coupled with plate 670 and be rotatably supported thereby. The transmission 672 can further define a ratio of rotation between the slack roller 660 and the vertical roller 664, as described above.

The motion generator, such as transmission 672, can be biased such that when released, the motion generator can unfurl the lower canopy 636 from the vertical roller 664. In some embodiments, the motion generator comprises a spring 690, like the spring 290, the weight of a lower bar 640 (FIG.

11A), or a motor coupled with the transmission for rotating components of the transmission 672. In some embodiments, the transmission 672 further comprises a cylindrical member 691 on which the spring 690 is coiled and comprising a structure and function similar to cylindrical member 291. The cylindrical member 691 can comprise a lower cylindrical portion 691*a* and an upper ridge 691*b*. The lower cylindrical portion 691*a* can include a central aperture within which the axle 674 can be received. The spring 690 is biased such that when released, the potential energy of the spring can be used to unfurl the lower canopy 636 from the vertical roller 664. In some embodiments this can include sufficient potential energy on its own to completely unfurl the lower canopy 636. In other embodiments the potential energy of the spring 690 coupled with the potential energy of the lower bar 640 is used to completely and/or partially unfurl the lower canopy 636 from the vertical roller 664.

Figure 13A:
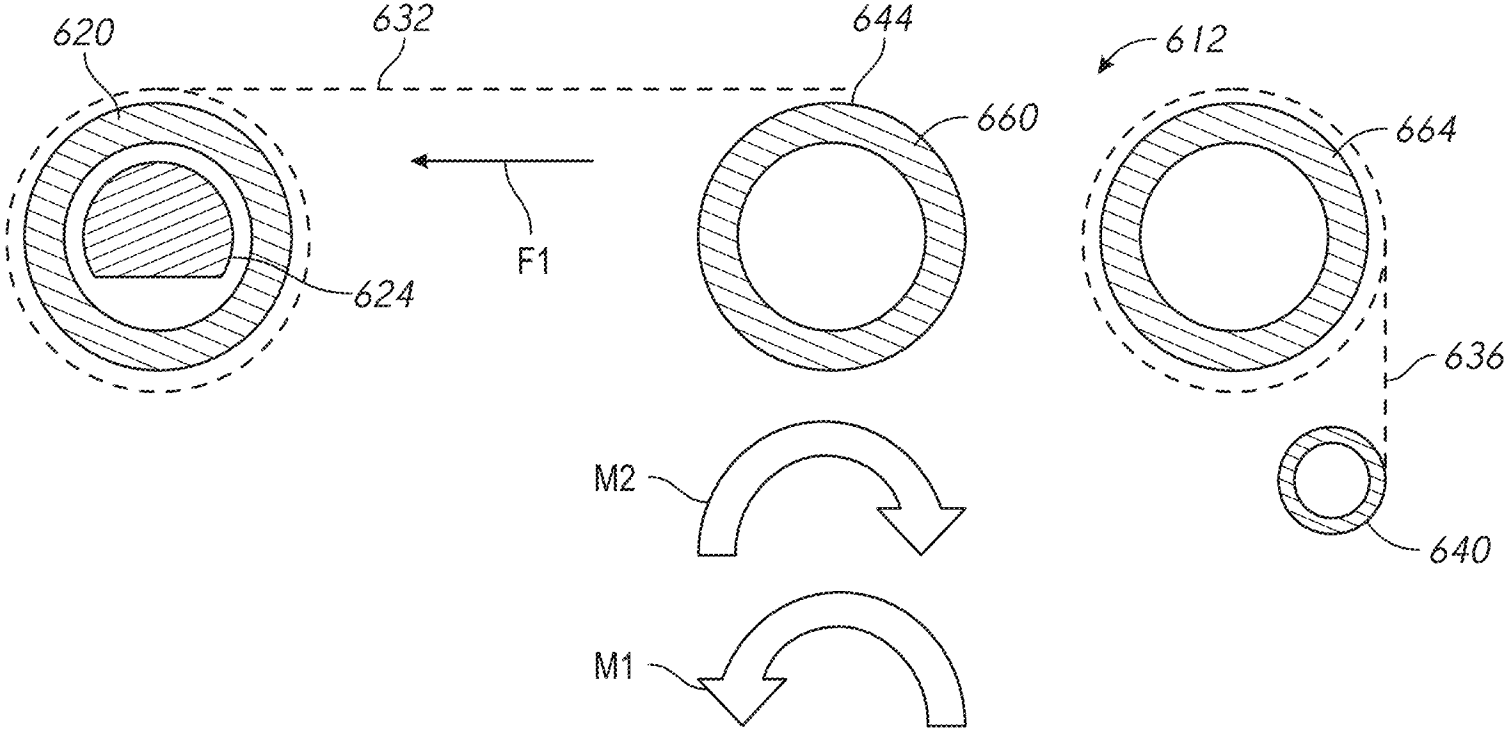
FIG. 13A-13C show a schematic view of a braking mechanism.

The extension of the extendable arms 650 away from the mounting structure 608 and the movement of the extendable bar assembly 612 into the extended position can be controlled by the awning extender 610. As depicted in FIG. 13A, as the extendable arms extend from the stowed position, the upper canopy 632, coupled with the extendable bar assembly 612 on one end, can be unfurled from the base roller 620 and extended between the mounting structure 608 and the extendable bar assembly 612.

The rotation of the base roller 620 and the unfurling of the upper canopy 632 can be limited by the brake 624. The brake 624 of the base roller 620 can also create a tension F1 on the upper canopy 632 as it extends out away from the mounting structure 608 on the extendible arms 650. This tension F1 created in the upper canopy 632 also has the effect of preventing rotation of the slack roller 660. A first moment M1 on the slack roller from the tension F1 on the upper canopy 632 can prevent the slack roller from rotating to furl the slack length 648. A second moment M2 from the potential energy in the transmission 672 can also act on the slack roller 660 in the opposite direction to the first moment. So long as the first moment on the slack roller 660 from the tension in the upper canopy 632 is greater than the second moment from the transmission 672, the slack roller 660, in some embodiments, does not rotate as the extendable bar assembly 612 extends out from the mounting structure 608.

Figure 13B:
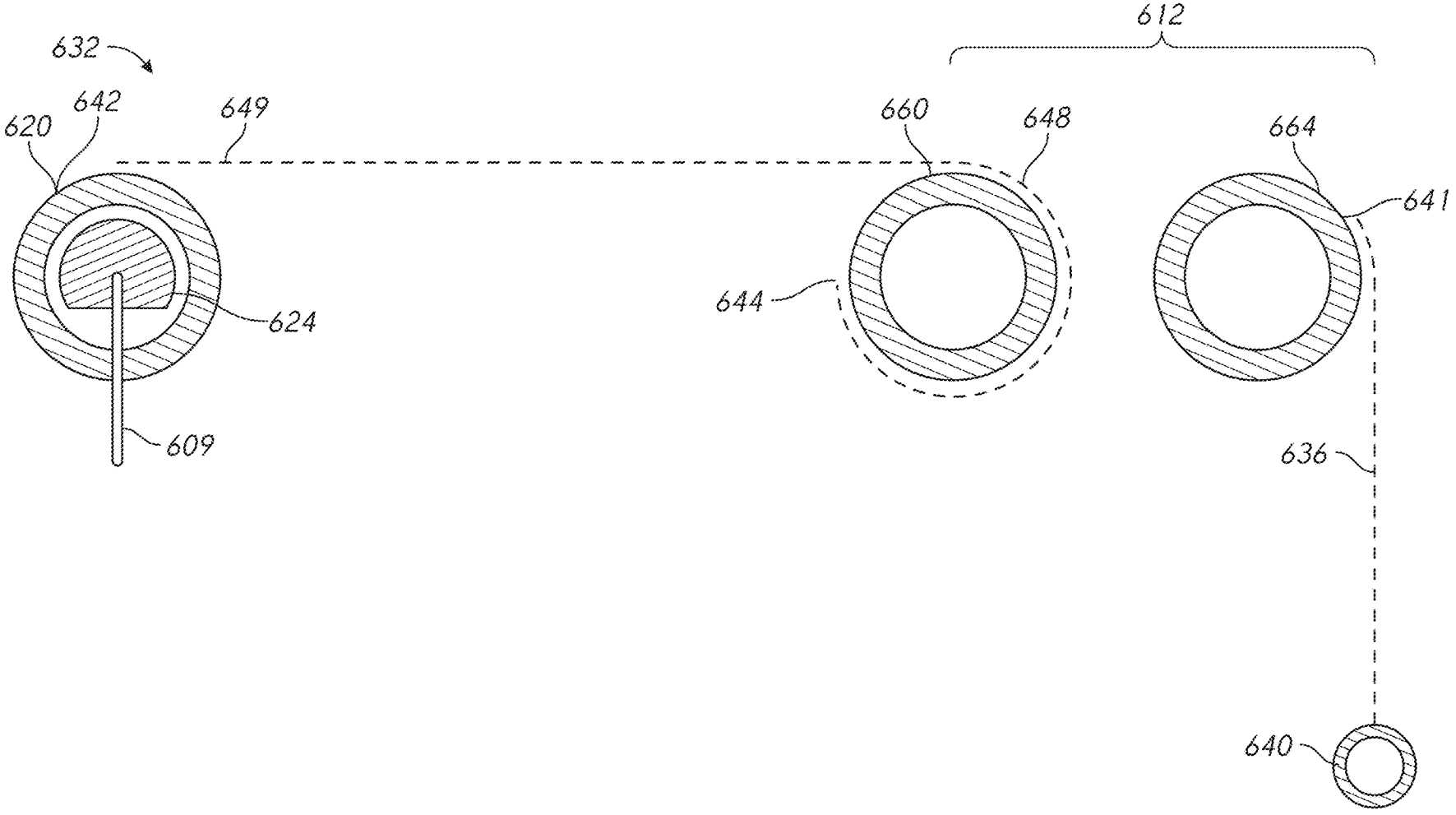

After the extendable bar assembly 612 reaches the extended position on the extendable arms 650, as shown in FIG. 13B, any further unfurling of a terminal length 649 (not shown) of the upper canopy 632 (e.g., by releasing the brake 624) by the awning extender 610 can create slack in the upper canopy 632 and reduce the tension. This can reduce the first moment M1, and allow a rotation of the slack roller 660 due to the second moment M2. The terminal length 649 that is unfurled from the base roller 620 after the extendable bar assembly 612 reaches its extended position can allow the slack roller 660 to furl the slack length 648 of the upper canopy 632.

In some embodiments, the brake 624 comprises a rubber foot stabilized locally relative to the mounting structure 608 and applied against the base roller 620, such as on an inside surface of the base roller 620. For example, the brake 624 can include a threaded shaft coupled with the rubber foot and supported by an extension of the mounting structure 608; the rotation of the threaded shaft can modify a pressure applied against the base roller 620. The brake 624 can be manually (such as by a user) released by lowering the pressure between the base roller and rubber foot of the brake 624 to allow the terminal length 649 to unfurl from the base roller 620. This releasing of the brake 624 can be performed after the extendable arms have be actuated to the extended position of the extendable bar assembly 612.

In some embodiments, the slack roller 660 is biased to furl the slack length 649 by the second moment M2 from the potential energy stored in the transmission 672, such as the spring 690 or the potential energy in the lower canopy bar 640 and/or the weight of the lower canopy 636. As the slack roller 660 rotates, the vertical roller 664 also rotates through its coupling with the slacker roller 660 via the transmission 672. The vertical roller 664 can unfurl a portion of the lower canopy 636 as the vertical roller 664 rotates. The ratio of rotation of the transmission 672, as similarly discussed above in the context of transmission 272, determines the ratios of the slack length 648 and the portion of the lower canopy 636 unfurled from the vertical roller 664.

The process of releasing the brake 624 can be continued until all of the terminal length 649 is unfurled from the base roller 620 or the potential energy of the transmission 672 is expended. In some embodiments, the transmission contains enough potential energy to unfurl the entire lower canopy 636 and still maintain the second moment M2 such that the second moment M2 creates a tension F1 across the upper canopy 632.

Figure 13C:
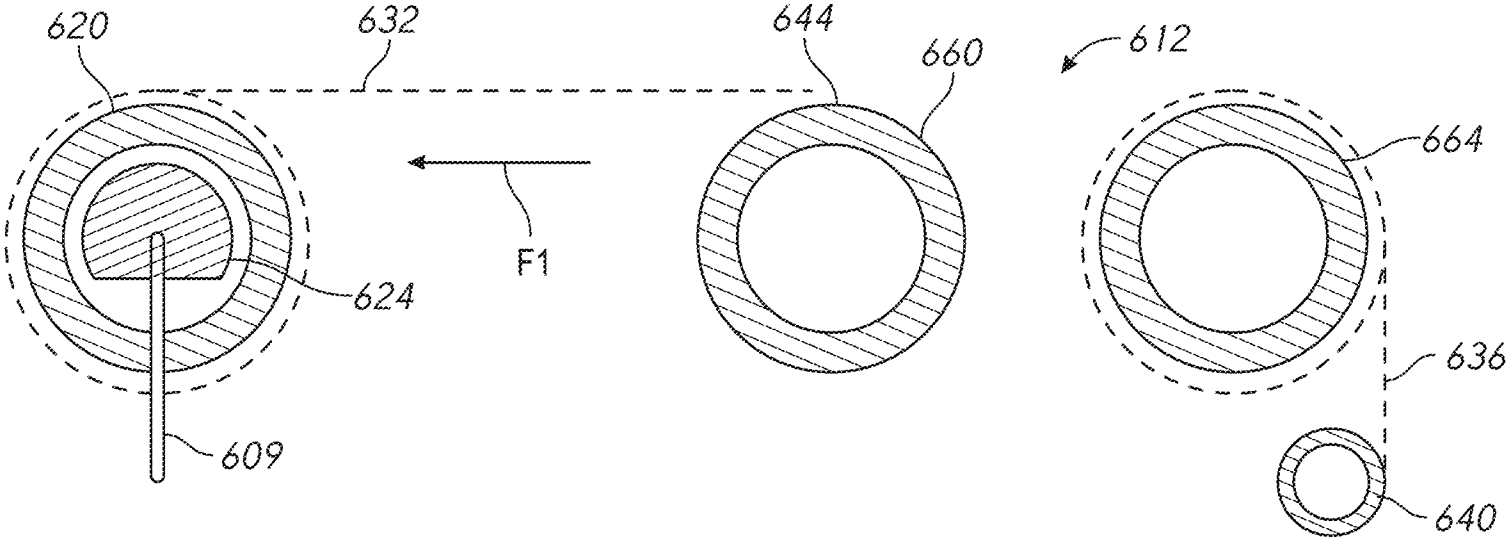

As depicted in FIG. 13C, to furl the upper canopy 632 about the base roller 620, the base roller 620 can include a rotatable shaft 609 coupled with a hand crank or motor for rotating the base roller 620 to furl the upper canopy 632. The brake 624 can also be engaged to bias the base roller 620, such that the brake 624 creates tension F1 in the upper canopy 632. Rotating the base roller 620, such as with the rotatable shaft 609, can result in furling the terminal length 649 about the base roller 620. Tension F1 from rotating the base roller 620, such as with the rotatable shaft 609, can result in the first moment M1 being larger than the second moment M2 on the slack roller 660 and thereby cause the slack roller 660 to rotate to unfurl the slack length 648. The rotation of the slack roller 660 allows the rotation of the vertical roller 664 (via the transmission 672) to retract the lower canopy 636. Rotation of the of the base roller 620 with the rotatable shaft 609 to furl the upper canopy 632 about the base roller 620 and furl the lower canopy 636 about the vertical roller 664 can also be coupled with or performed in addition to the awning extender 610 being actuated to retract the extendable arms 650 and to stow the extendable bar assembly 612 adjacent to the mounting portion 608. The extension and/or retraction of both the upper canopy 632 and the lower canopy 636 can be controlled by actuating the awning extender 610, the brake 624 and/or rotatable shaft 609.

EXAMPLE EMBODIMENTS

Example embodiment A—an awning assembly, comprising: an awning frame assembly comprising a moveable housing and a support arm, the support arm having a first end configured to couple with a ground surface and a second end coupled with the moveable housing; an upper canopy having an end coupled with the extendable housing, the upper canopy being extendable upon movement of the moveable housing away from the ground surface; a lower canopy having an end coupled with the moveable housing, the lower canopy being extendable away from the moveable housing; and a transmission coupled with the upper canopy and with the lower canopy to tension the upper canopy and to deploy the lower canopy.

Example embodiment B—an awning assembly, comprising: an awning frame assembly comprising a moveable housing and a support arm, the support arm having a first end configured to couple with a ground surface and a second end coupled with the moveable housing; an upper canopy having an end coupled with the extendable housing, the upper canopy being extendable upon movement of the moveable housing away from the ground surface; a lower canopy having an end coupled with the moveable housing, the lower canopy being extendable away from the moveable housing; and a transmission comprising a spring coupled with the lower canopy and configured to store strain energy and to use the strain energy to deploy the lower canopy from the moveable housing.

Example embodiment C—an awning assembly, comprising: an awning frame assembly comprising a moveable housing and a support arm, the support arm having a first end configured to couple with a ground surface and a second end coupled with the moveable housing; an upper canopy having an end coupled with the extendable housing, the upper canopy being extendable upon movement of the moveable housing away from the ground surface; a lower canopy having an end coupled with the moveable housing, the lower canopy being extendable away from the moveable housing; and a first roller disposed in the moveable housing and coupled with the upper canopy, a second roller disposed in the moveable housing and coupled with the lower canopy, the first and second rollers being rotationally coupled to each other.

Example embodiment D—The awning assembly of example embodiment A or B, wherein the transmission is configured to simultaneously tension the upper canopy and deploy the lower canopy.

Example embodiment E—The awning assembly of example embodiments A-D, wherein a length of the upper canopy is wound about a roller disposed in the moveable housing while the lower canopy is unwound from a roller and extended from the moveable housing.

Example embodiment F—The awning assembly of example embodiments A-E, wherein the awning assembly is retractable by first unwinding a length of the upper canopy from a first roller disposed in the moveable housing, until the lower canopy is fully rolled about a second roller disposed in the moveable housing.

Example embodiment G—The awning assembly of example embodiment F, wherein a third roller configured to be disposed adjacent to the ground surface is configured to wind the upper canopy until the lower canopy is fully wound about the second roller, the awning assembly configured such that further winding of the upper canopy about the third roller moves the moveable housing toward the ground surface.

Example embodiment H—The awning assembly of example embodiment F, wherein the first roller is rotationally coupled with the second roller by a transmission on or in the extendable bar assembly.

Example embodiment I—The awning assembly of example embodiment H, wherein a rotation of the first roller furls a slack length of the upper canopy onto the first roller and a corresponding rotation of the second roller unfurls a corresponding length of the lower awning canopy from the second roller.

Example embodiment J—The awning assembly of example embodiment I, wherein a rotation of the first roller unfurls a slack length of the upper canopy from the first roller and a corresponding rotation of the second roller furls a corresponding length of the lower canopy onto the second roller.

Example embodiment K—The awning assembly of example embodiment I, wherein the second end of the upper canopy is configured to apply a first tensioning force on the first roller resulting in a first moment on the first roller as the extendable bar assembly is extended between the compact position and the extended position and is configured to apply a second tensioning force on the first roller resulting in a second moment on the first roller in the extended position, the first moment preventing rotation of the first roller and the second moment allowing rotation of the first roller.

Example embodiment L—The awning assembly of example embodiments A, B, or D-K, wherein the transmission comprises a biasing element that stores energy as the lower canopy is retracted into the moveable housing, the stored energy of the biasing element configured to release the stored energy to extend the lower canopy from the moveable housing.

Example embodiment M—The awning assembly of example embodiment L, wherein the biasing element comprises a spring.

Example embodiment N—A method of extending an awning assembly, comprising: extending a support arm to extend away from a ground surface to move a housing away from the ground surface, to extend an upper canopy away from the ground surface; further extending a length of the upper canopy away from the ground surface after the support arm is fully extended; engaging a transmission disposed in the housing to move a first roller disposed in the housing to wind up a slack length of the upper canopy to tension the upper canopy and to move a second roller disposed in the housing to unfurl a length of a lower canopy from within the housing.

Example embodiment O—The method of example embodiment N, wherein a ratio of the slack length to the length of the lower canopy being unfurled is defined substantially by the transmission.

Example embodiment P—The method of example embodiment O, wherein the ratio is in the range of 1:1 to 1:10.

Example embodiment Q—The method of example embodiment P, wherein extending the support arm further comprises unwinding a base roller to extend the upper canopy and further extending the length comprises further unwinding the base roller.

As used herein, the relative terms "top" and "bottom" shall be defined from the perspective of an upright vertically supported umbrella assembly. Thus, top or upper refers the direction toward the exposed side of the upper canopy 132, 632 when so supported.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Further, the actions of the disclosed processes and methods may be modified in any manner, including by reordering actions and/or inserting additional actions and/or deleting actions. Thus, it is intended that the scope of at least some of the present inventions herein disclosed should not be limited by the particular disclosed embodiments described above. The limitations in the claims are to be interpreted broadly based on the language employed in the claims and not limited to the examples described in the present specification or during the prosecution of the application, which examples are to be construed as non-exclusive.

What is claimed is:

1. An awning assembly, comprising:

an awning frame assembly comprising a mount portion, an extendable bar assembly, and an extendable arm having a first end coupled with the mount portion and a second end coupled with the extendable bar assembly;

an upper canopy having a first end coupled with the mount portion and a second end coupled with the extendable bar assembly, the upper canopy being retractable to a compact configuration and extendable to an extended position upon extension of the extendable arm;

a lower canopy having a first end coupled with the extendable bar assembly and a second end extendable from the extendable bar assembly, the lower canopy being retractable to a compact configuration within the extendable bar assembly and extendable from the extendable bar assembly;

wherein the extendable bar assembly comprises:

a first roller coupled with the second end of the upper canopy;

a second roller coupled with the first end of the lower canopy; and a transmission coupling rotation of the first roller with rotation of the second roller;

wherein potential energy stored in a motion generator of the extendible bar assembly is configured to rotate the second roller to extend the lower canopy and rotate the first roller to tension the upper canopy.

2. The awning assembly of claim 1, wherein the transmission comprises:

a first gear coupled to a first axle, the first axle coupled to the first roller; and a second gear coupled to a second axle, the second axle coupled to the second roller.

3. The awning assembly of claim 2, wherein the transmission is configured to advance in a first direction to wind the second end of the upper canopy around the first roller and unfurl the lower canopy from the second roller; and wherein the transmission is configured to advance in a second direction to unfurl the second end of the upper canopy from the first roller and wind the lower canopy from the second roller.

4. The awning assembly of claim 1, wherein the upper canopy has a shade length and a slack length, the shade length being a perpendicular distance from a portion of the mount portion facing the extendable bar assembly to a portion of the extendable bar assembly facing the mount portion when the extendable bar assembly is fully extended away from the mount portion, the slack length being an additional length of the upper canopy configured to furl on the first roller with the upper canopy in the extended position.

5. The awning assembly of claim 1, wherein the potential energy is stored in a spring, the spring configured to release stored strain energy to simultaneously extend the lower canopy and to tension the upper canopy.

6. The awning assembly of claim 1, wherein the transmission is driven by a spring of the motion generator disposed in a housing, the housing disposed at one end of the extendable bar assembly.

7. An awning assembly, comprising:

an awning frame assembly comprising a moveable housing and a support arm, the support arm having a first end configured to couple with a ground surface and a second end coupled with the moveable housing;

an upper, generally horizontal canopy having an end coupled with a first roller within the moveable housing, the upper canopy being extendable upon movement of the moveable housing away from the ground surface;

a lower, generally vertical canopy having an end coupled with a second roller within the moveable housing, the lower canopy being extendable away from the moveable housing; and a transmission coupled with the first roller and the second roller;

wherein advancement of the transmission in a first direction is configured to tension the upper canopy and deploy the lower canopy.

8. The awning assembly of claim 7, wherein the transmission comprises a spring configured to simultaneously tension the upper canopy and deploy the lower canopy.

9. The awning assembly of claim 8, wherein the transmission is configured to wind a length of the upper canopy about the first roller disposed in the moveable housing while unfurling the lower canopy from the second roller.

10. An awning assembly, comprising:

an awning frame assembly comprising a moveable housing and a support arm, the support arm having a first end configured to couple with a ground surface and a second end coupled with the moveable housing;

an upper canopy having an end coupled with a first roller within the moveable housing, the upper canopy being extendable upon movement of the moveable housing away from the ground surface;

a lower canopy having an end coupled with a second roller within the moveable housing, the lower canopy being extendable away from the moveable housing; and a transmission coupled with the first roller and the second roller;

wherein advancement of the transmission in a first direction is configured to tension the upper canopy and to deploy the lower canopy;

wherein advancement of the transmission in a second direction is configured to retract the lower canopy and wind the lower canopy about the second roller while unwinding a length of the upper canopy from the first roller.

11. The awning assembly of claim 10, wherein the ground surface includes a third roller and rotation of the third roller is configured to wind the upper canopy about the third roller, to advance the transmission in the second direction, and to retract the moveable housing towards the ground surface.

12. An awning assembly, comprising:

an awning frame assembly comprising a mount portion, an extendable bar assembly, and an extendable arm having a first end coupled with the mount portion and a second end coupled with the extendable bar assembly;

an upper canopy having a first end coupled with a base roller of the mount portion and a second end coupled with a first roller of the extendable bar assembly, the upper canopy configured to be retractable about and extendable from the base roller, the first roller configured to rotate in a first direction to wind and/or tension a portion of the upper canopy;

a lower canopy having a first end coupled with a second roller of the extendable bar assembly and a second end extendable from the extendable bar assembly, the lower canopy configured to retract about the second roller and extend downwards from the extendable bar assembly;

the extendable bar assembly configured to extend from a stowed position adjacent the mount portion to an extended position spaced laterally from the mount portion wherein rotation of the first roller in the first direction causes rotation of the second roller and downward extension of the lower canopy.

13. The awning assembly of claim 12, wherein the first roller is rotationally coupled with the second roller by a transmission on the extendable bar assembly.

14. An awning assembly, comprising:

an awning frame assembly comprising a mount portion, an extendable bar assembly, and an extendable arm having a first end coupled with the mount portion and a second end coupled with the extendable bar assembly;

an upper canopy having a first end coupled with a base roller of the mount portion and a second end coupled with a first roller of the extendable bar assembly, the upper canopy configured to retract about the base roller and extend from the base roller with the extension of the extendable arm;

a lower canopy having a first end coupled with a second roller of the extendable bar assembly and a second end extendable from the extendable bar assembly, the lower canopy configured to retract about the second roller and extend downwards from the extendable bar assembly;

the extendable bar assembly configured to extend from a stowed position adjacent the mount portion to an extended position spaced laterally from the mount portion;

wherein the first roller is rotationally coupled with the second roller by a transmission on the extendable bar assembly;

wherein the extendable bar assembly is configured to release potential energy to rotate the first roller in a first direction and thereby furl a slack length of the upper canopy onto the first roller and to rotate the second roller in a second direction to unfurl a corresponding length of the lower canopy from the second roller.

15. The awning assembly of claim 14, wherein rotation of the first roller in a third direction, opposite the first direction, is configured to unfurl the slack length of the upper canopy from the first roller and rotate the second roller in a fourth direction, opposite the second direction, to furl the corresponding length of the lower canopy onto the second roller.

16. The awning assembly of claim 14, wherein the potential energy of the extendable bar assembly is configured to apply a first tensioning force on the upper canopy and a first moment on the first roller as the extendable bar assembly is extended between the stowed position and the extended position and the potential energy is configured to be released in the extended position to unfurl the lower canopy from the second roller and furl the slack length on the first roller in the extended position.

17. The awning assembly of claim 16, wherein the transmission comprises a biasing element configured to store the potential energy.

18. The awning assembly of claim 16, wherein the biasing element comprises a spring coupled with the transmission or a lower bar coupled with the lower canopy.

19. The awning assembly of claim 15, wherein rotating the first roller in the third direction and rotating the second roller in the fourth direction is configured to increase the potential energy in the extendible bar assembly.

20. An awning assembly, comprising:

an awning frame assembly comprising a mount portion, an extendable bar assembly, and an extendable arm having a first end coupled with the mount portion and a second end coupled with the extendable bar assembly;

an upper canopy having a first end coupled with a base roller of the mount portion and a second end coupled with a first roller of the extendable bar assembly, the upper canopy configured to be retractable about and extendable from the base roller, the first roller configured to rotate to wind and/or tension a portion of the upper canopy;

a lower canopy having a first end coupled with a second roller of the extendable bar assembly and a second end extendable from the extendable bar assembly, the lower canopy configured to retract about the second roller and extend downwards from the extendable bar assembly;

the extendable bar assembly configured to extend from a stowed position adjacent the mount portion to an extended position spaced laterally from the mount portion;

wherein the first roller is rotatable about first axis and the second roller is rotatably about a second axis, the first axis spaced a lateral distance from the second axis on the extendible bar assembly.

* * * * *